US006757917B2

(12) United States Patent
Kamysz et al.

(10) Patent No.: US 6,757,917 B2
(45) Date of Patent: Jul. 6, 2004

(54) LOW MAINTENANCE HYGIENIC TOILET SEAT

(75) Inventors: Mark Kamysz, Kildeer, IL (US); Charles Zimnicki, Bartlett, IL (US)

(73) Assignee: Seat One, Inc., Kildeer, IL (US)

( * ) Notice: Subject to any disclaimer, the term of this patent is extended or adjusted under 35 U.S.C. 154(b) by 0 days.

(21) Appl. No.: 10/054,533

(22) Filed: Jan. 22, 2002

(65) Prior Publication Data

US 2002/0162164 A1 Nov. 7, 2002

Related U.S. Application Data

(60) Provisional application No. 60/263,280, filed on Jan. 22, 2001.

(51) Int. Cl.[7] ..... A47K 13/14

(52) U.S. Cl. ..... 4/243.2; 4/243.1; 4/244.1; 4/245.2; 4/244.2; 4/244.3

(58) Field of Search ..... 4/243.2, 244.1, 4/245.2, 246, 243.1, 244.2

(56) References Cited

U.S. PATENT DOCUMENTS 3,967,325 A * 7/1976 Rodriguez ..... 4/245
4,106,135 A * 8/1978 Mannheim ..... 4/247
4,760,613 A * 8/1988 Bobak ..... 4/247
4,766,618 A * 8/1988 Boker ..... 4/243
4,926,505 A * 5/1990 Highuchi et al. ..... 4/247
4,926,506 A * 5/1990 Wang ..... 4/247
5,238,138 A * 8/1993 Bois ..... 220/830
5,253,372 A * 10/1993 Boker ..... 4/243.2

* cited by examiner

*Primary Examiner*—Henry Bennett
*Assistant Examiner*—Azadeh Kokabi
(74) *Attorney, Agent, or Firm*—IP Focus Law Group, Ltd.

(57) ABSTRACT

The present invention provides a toilet seat assembly that can be assembled and disassembled without the use of tools by aligning various components of the assembly at a predetermined angle with respect to one another. Another aspect of the invention includes a system composed of a plurality of toilet seat assemblies that communicate information onto and receive information from a computer network that can include the Internet in one embodiment. Another aspect of the invention includes a kit for serviceing the assembly of the invention that includes a plurality of rolls of plastic sleeves.

11 Claims, 17 Drawing Sheets

LOW MAINTENANCE HYGIENIC TOILET SEAT

PRIORITY DATA

This application claims priority from U.S. Provisional Patent Application No. 60/263,280 filed on Jan. 22, 2001 and entitled Low Maintenance Hygienic Toilet Seat and incorporates by reference its contents.

BACKGROUND OF THE INVENTION

This invention relates to toilet seats in general, and more particularly, relates to a low maintenance hygienic toilet seat assembly that dispenses an anti-microbial plastic sleeve.

U.S. Pat. No. 4,213,212 issued to Hefty et al. ("Hefty et al.") briefly discusses the state of the art of applying hygienic covers to toilet seats. Hefty et al. describes a variety of earlier arrangements covered by German patents and relates to an arrangement for dispensing from a supply reel a tubular plastic feed on one end of a toilet seat to be pulled the length of the toilet seat and then wound up on a take-up reel on the other end.

The arrangement of Hefty et al. requires that one end of the horseshoe spaced toilet seat be free, or in effect, floating, in order for the tubular plastic material being dispensed to be fed onto and surround the seat itself. The necessity for surrounding the seat is dictated by the need to insure that the plastic covering will not fall off the top of the seat, a problem generally associated with previous devices as described by the patentees.

Several drawbacks are associated with the device described in the above referenced patent. The presence of a free end of the horseshoe shaped seat can interfere with the movement of the tubular plastic material from the supply reel if the free end is inadvertently or intentionally pulled away from the top of the commode. Other potential problems can be caused by twisting of the plastic on the seat resulting in jamming of the device, or tearing of the plastic which can result in a total failure of operation.

U.S. Pat. No. 4,766,618 to Boker ("Boker") attempted to solve some of the problems of the prior art, but at the same time created new ones. The toilet seats discussed in these patents are typically used in publicly accessible restrooms. These restrooms require daily or even more frequent cleaning by cleaning personnel. Boker does not provide for ease of cleaning since the seat of Boker and the sleeve dispensing assembly rest directly on the toilet seat and permit for unwanted fecal matter and other excrement to build up on the assembly of Boker. It is an object of the present invention to solve the problems of the prior art.

The prior art also has problems in that it has been proposed that the amount of film on a take up roll is determined through means that determine only one sleeve usage distance. However, users manually pull out fresh sleeve which creates a undesirable sleeve build up that interferes with the proper functioning of the unit since the unit is only calibrated to dispense a predetermined amount of sleeve per usage.

Another problem in the art is that units have single or multiple wires that stick out of the unit. These wires are damaged by careless users who rip them out or fray them.

The prior art also features brackets that mount the seat to the toilet bowl. There is no way to clean under these mounting brackets without removing the mounting bolts. Consequently, repair and maintenance of these prior art seats is costly and time consuming.

Another problem in the art relates to the wind up of used sleeve on a take up roll. The problem in the art is that winding up of used sleeve on a take up roll is not perfectly tight and smooth. As a result, the take up roll sleeve doubles up in the art and becomes full prematurely.

An additional problem in the art relates to the inability to clean the area between a lower housing and a seat ring.

Another problem in the art relates to sleeve twisting. The problem is that new clean sleeve twists when it goes around a seat ring. Consequently, the bottom part of the originally clean sleeve portion drags against the dirty toilet bowl or wet interior surface of the unit, and then becomes the top part of the sleeve. Users unwittingly then sit on what they thought was fresh clean sleeve. In reality, the sleeve is contaminated with urine and fecal material. Hence, the seating surface of the new sleeve is contaminated with waste on many occasions.

All of the prior art systems have a significant drawback in that they do not provide for a toilet seat that provides for economical daily maintenance, cleaning and repair. It is an object of the invention to solve this and other problems in the art.

SUMMARY OF THE INVENTION

The present invention provides a low maintenance toilet seat assembly including a dispensing apparatus for a plastic sleeve. The toilet seat assembly includes a pair of substantially C-shaped mounting forks for rotatably mounting the toilet seat assembly to a toilet bowl. The substantially C-shaped mounting forks have a mounting fork base assembly of an effective height to provide for relatively effortless cleaning between a lower housing of the toilet seat assembly and the toilet bowl.

It is another object of the invention to provide a toilet seat assembly further including a lower housing. The lower housing is constructed to be releasably matable to the substantially C-shaped mounting forks. The lower housing has an outer cover which is rotatably connected to the lower housing. The outer cover is secured to the lower housing with a keyed lock. Within the housing and cover is an electric motor removably connected to the lower housing. The motor is mounted in a slotted motor stand in the lower housing.

Yet another object of the invention is to provide a toilet seat assembly comprising an electronic sensor disposed on the dispenser assembly and accessible through the top of the outer cover. The electronic sensor actuates an electric motor. A display is also disposed on the dispenser assembly and is viewable through the top of the outer cover. The display provides a readout of true fresh roll distance. The readout is correlated to a magnetic reading of a magnet signal in one embodiment.

It is yet another object of the invention to provide a toilet seat assembly that can be removed from a toilet bowl only at a predetermined, assembly angle.

In yet another variant of the invention, it is an object of the invention to provide an outer cover for a toilet seat assembly that can only be removed at certain predetermined angles.

It is yet another object of the invention to provide to provide a lower housing for a toilet seat assembly that can be removed if entire assembly is rotated to a predetermined angle.

The objects and features of the present invention, other than those specifically disclosed herein, will become more apparent in the detailed description of the invention and drawings set forth below.

DETAILED DESCRIPTION OF DRAWINGS

The present inventive toilet seat assembly offers numerous advantages over the prior art devices. The numerous aspects of the invention, which will be described herein, result in a low maintenance, easy to clean and maintain, and secure toilet seat assembly for dispensing an anti-microbial sleeve around the toilet seat. Furthermore, the toilet seat assembly components are constructed so that they can be cleaned without removal of the assembly from the bathroom in which the toilet is located. Structurally, the assembly comprises a plurality of layered exterior components that create an internal cavity for the mechanized components of the assembly. At least some of these layered components provide support for the other layered components when pressure is exerted on the assembly. It is appreciated that this solves the problem of a user damaging the assembly by accidentally sitting on the assembly, rather than the seat.

Figure 1:
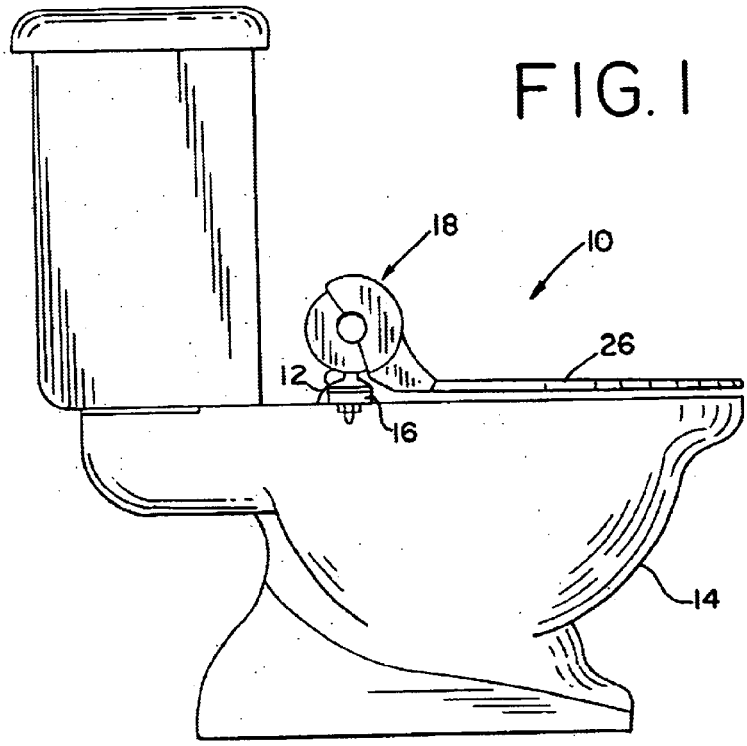
FIG. 1 shows a side elevation of a toilet incorporating the toilet seat assembly of the present invention.
Figure 2:
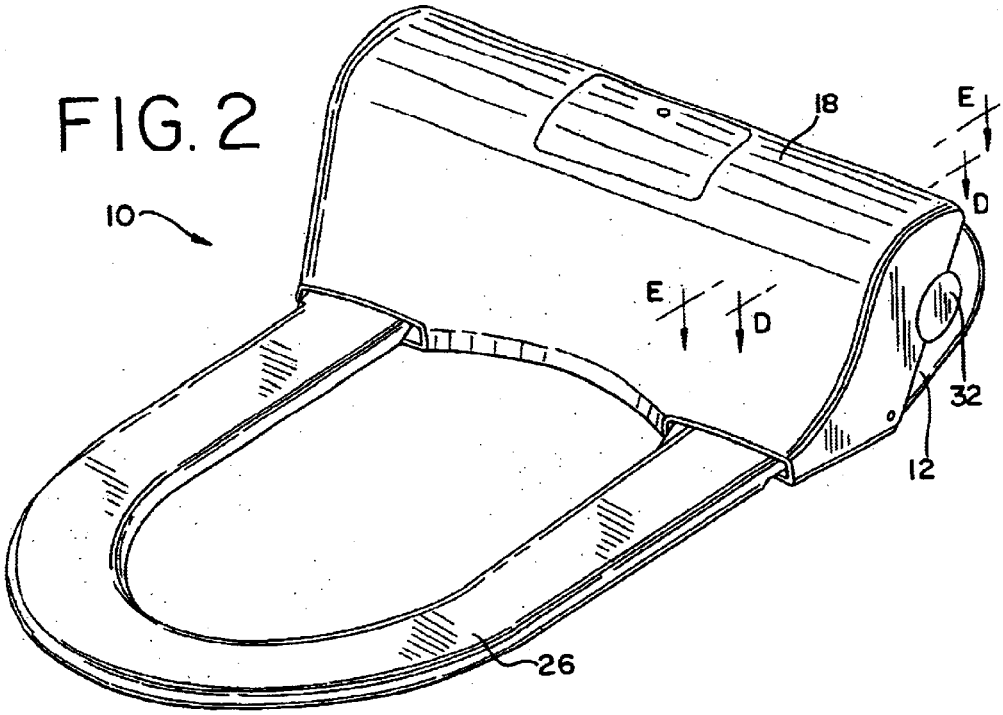
FIG. 2 shows a perspective view of the inventive toilet seat assembly.
Figure 3:
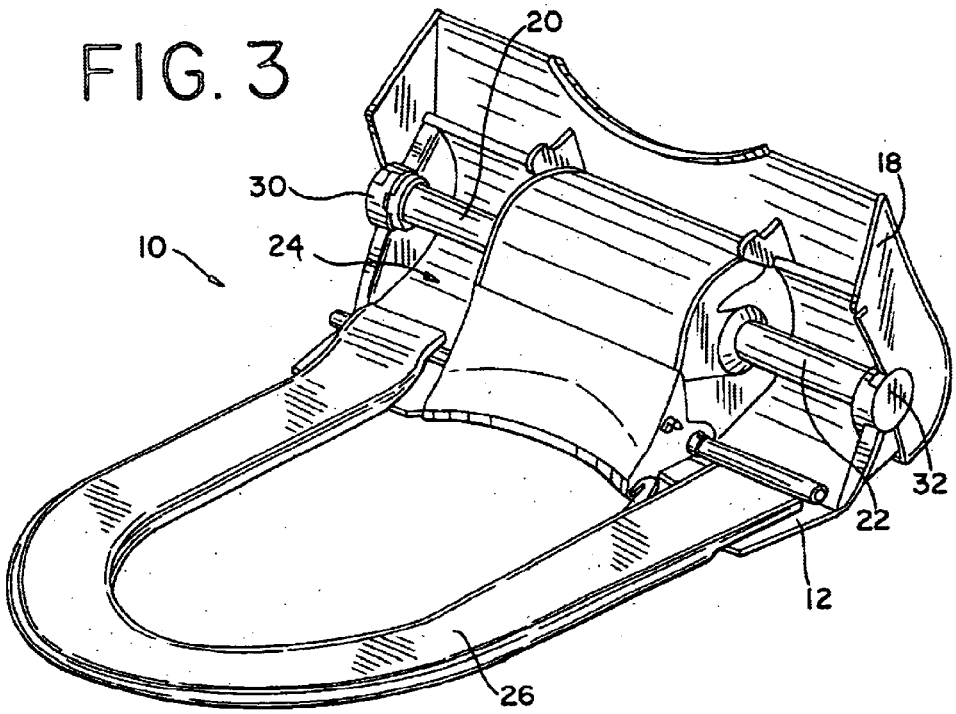
FIG. 3 shows a perspective view of the inventive toilet seat assembly showing the internal mechanisms of the assembly.

FIGS. 1–3 show a preferred embodiment of the invention 10, the layering comprises a lower layer 12, i.e. a bridge or lower housing, mounted to a toilet 14 with a pair of mounting fork assemblies 16, 17, and an upper layer 18, i.e. an outer cover. At least one portion of the upper layer of components is substantially congruent to a portion of the lower layer of components. This substantial congruence provides for added surface area support for the various components of the assembly 10. For example, as pressure is placed on the outer cover 18, it gently bends down and rests against the lower housing 12. The same support is provided by various other components of the invention described herein. This layered component structure also provides for ease of cleaning and maintenance of the assembly.

Another aspect of the construction of the present inventive toilet seat assembly 10 is that the various components of the assembly are assembled and disassembled by rotation of the assembly or its component parts to a predetermined angle in relation to the toilet bowl (or in relation of one component to another). First, the components of the assembly 10 can be disassembled or assembled by rotation of the toilet seat assembly 10 or the individual components to a predetermined angle. Broadly stated, one of the underlying principles of the present invention is to provide a toilet seat assembly 10 comprising at least one component that is removable from a second component upon rotation of the first component to a predetermined angle in relation to the second component.

This principle is demonstrated in the present invention by the use of components or component housings that have substantially cylindrical shapes enabling the nesting of the components upon completion of the assembly. For example, the outer cover 18 rotatably and releasably mates over the lower housing 12 to form an interior cavity. This arrangement enables easy access to the supply and take-up bobbin assemblies 20, 22 and the working mechanisms of the dispensing apparatus 24 for cleaning, maintenance and replacement of the used anti-microbial sleeve.

An added benefit of this feature is that at least some of the components of the assembly are assembled or disassembled without the use of a tool when the components are brought into proper alignment with each other at the assembly angle, or stated another way, along the assembly plane. The toilet seat assembly 10 also utilizes self-draining components, i.e. flat, non-grooved inner surfaces with rounded or annular corners, to further reduce the collection of moisture and fluid in the assembly 10 and subsequently, reduce downtime for cleaning and repair.

Another advantage over the prior art is the inclusion of a series of sensors for collecting data about the operation of the assembly. The sensors monitor various operational characteristics of the assembly, including how much anti-microbial sleeve has been used and the remaining supply, and can further track the frequency of cleaning and maintenance of the assembly.

Still another aspect of the present invention providing advantages over the prior art is the incorporation of a communication system to forward the operational data collected by the sensors to a central processing unit for analysis. This provides for efficient, centralized monitoring of the maintenance of a number of assemblies.

The above-referenced features, and the numerous additional features which be described herein, make the present inventive toilet seat assembly ideal for use in environments with numerous bathroom facilities requiring frequent cleaning and maintenance, such as airports, stadiums and arenas, and office buildings.

Referring to FIGS. 1–4, the assembly 10 includes a dispensing apparatus 24 for dispensing an anti-microbial, plastic sleeve (not shown) that is provided on a supply bobbin assembly 20. The anti-microbial sleeve is generally transparent in nature and travels around the seat ring 26 onto the take-up bobbin assembly 22. It is appreciated that the plastic sleeve can be made from a plastic material that has anti-microbial properties in one variant of the invention. An outer cover 18 rotatably and releasably mates with a lower housing 12 of the assembly 10 at the supply and take-up bobbins ends 30, 32 to expose the internal mechanisms of the toilet seat assembly 10.

The lower housing 12 is comprised from a semi-cylindrical back wall 34, a ramped segment 36 and a self-draining lip 38. Opposing sidewalls 40, 42 are formed integral with and between the back wall 34 and ramped section 36. The self-draining lip 38 permits water, cleaning fluid and/or waste to run off from the interior cavity during cleaning and/or use of the assembly 10. The self-draining lip further includes a first and second recess 44, 46 configured to receive the ends of the seat ring 26. The recesses 44, 46 also serve to further guide liquid into the toilet bowl 14 (FIG. 1).

Figure 5:
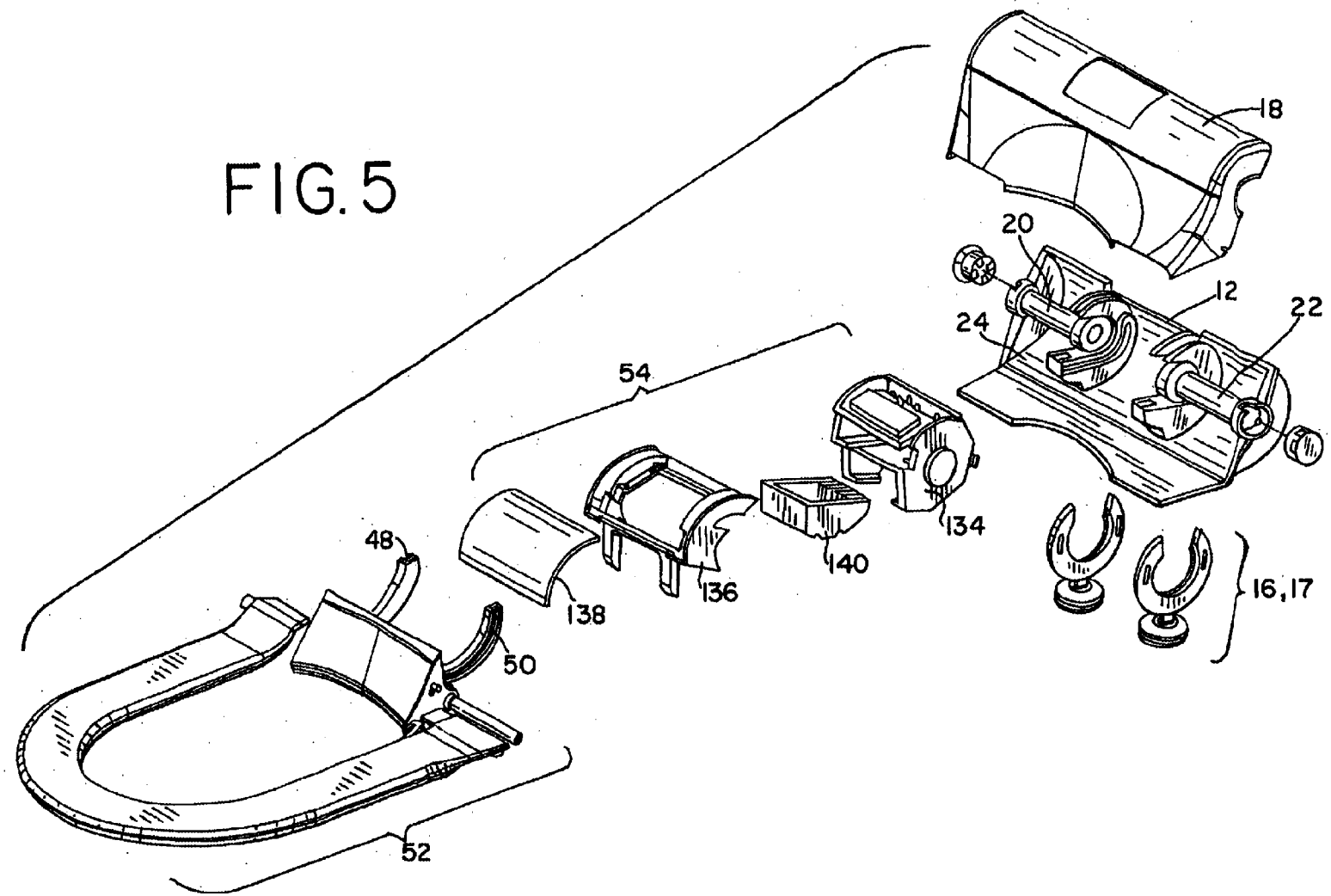
FIG. 5 shows an exploded perspective view of the toilet seat assembly of FIG. 2.

FIG. 5 shows an exploded view of the low maintenance toilet seat assembly 10. As previously disclosed, the outer cover 18 and lower housing 12 rotatably and releasably mate forming an interior cavity to hold the sleeve dispensing apparatus 24 and receive the arms 48, 50 of the seat assembly 52. The dispensing apparatus 24 comprises the supply and take-up bobbin assemblies 20, 22 releasably mated with the lower housing 12, and a motor housing assembly 54 that nests within the lower housing 12. The lower housing 12, in turn, rotatably and releasably mates with the toilet 14 (FIG. 1) via the mounting fork assemblies 16, 17.

Figure 4:
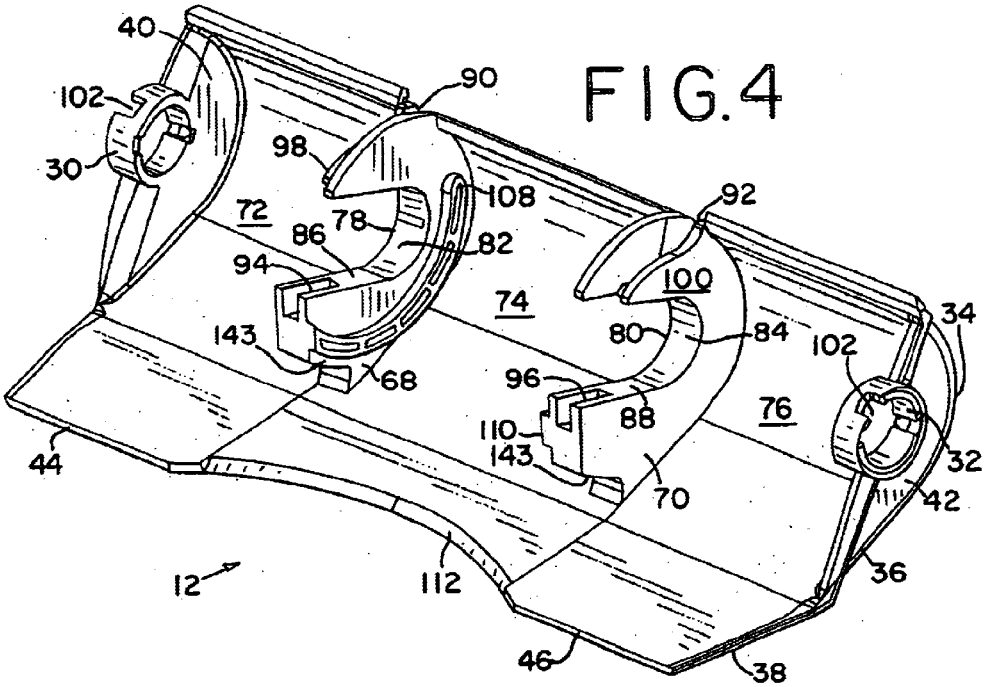
FIG. 4 shows a perspective view of a component of the toilet seat assembly of FIG. 2.
Figure 6:
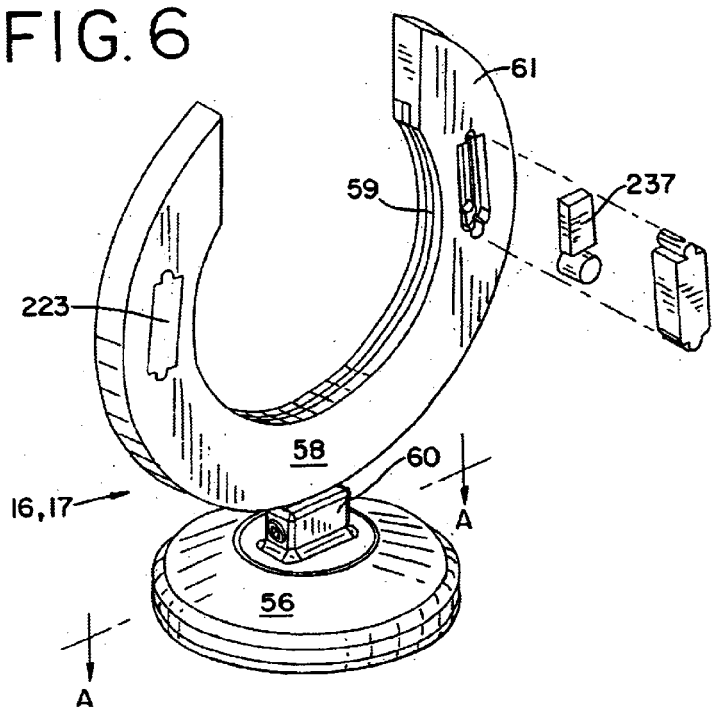
FIG. 6 shows a perspective view of a component of the toilet seat assembly of FIG. 2.
Figure 7:
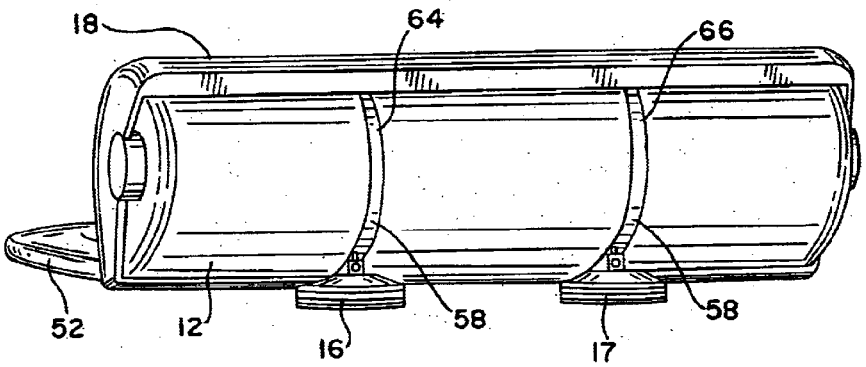
FIG. 7 shows a rear perspective view of components of the toilet seat assembly of FIG. 2.

FIGS. 4, 6–7 show the lower housing 12 and the mounting fork assemblies 16, 17 in greater detail. The mounting forks assemblies 16, 17 comprise a base 56 and substantially C-shaped fork 58. The base 56 is preferably of an effective height to provide for relatively effortless cleaning between the lower housing 12 and toilet bowl 14 (FIG. 1). In a preferred embodiment of the present invention, the mounting fork assembly 16, 17 or, alternatively, the lower housing 12, has an adjustable limit stop 60 (e.g., screw or other threaded member) thereon to adjust the seat ring 26 height in relation to the toilet seat assembly 10.

In yet another preferred embodiment, the base 56 and fork 58 are molded from a single piece of material, e.g. plastic, anti-microbial plastic material, and may be optionally reinforced with steel or some other appropriate material to provide added strength and support greater loads. While the use of a plurality of mounting fork assemblies is disclosed, it is also contemplated that the present invention can utilize only a single mounting fork assembly.

As is shown in FIG. 6, the fork 58 is composed of metal 59 surrounded in plastic 61. The benefits of this arrangement are two-fold. First, the metal adds structural integrity to the fork 58 and the stability to the entire assembly 10. Second, use of a conductive metal can provide the system with electrical power when connected to an electrical source. Therefore, it is appreciated that a battery or power lines may supply electricity to the toilet seat assembly of the present invention. Alternatively, the fork may provide electrical power to recharge the battery. The need for exposed electrical wires is eliminated because the electrified portion of the fork is exposed only to the internal cavity of the assembly 10. In this arrangement, it is appreciated that at least two forks are utilized with the assembly, the first fork acting as a positive lead and the second fork acting as a negative lead.

Alternatively, the mounting fork assemblies include a channel that accommodates an electrical wire. Providing the conductive elements within the mounting fork assemblies provides for further ease of cleaning of the assembly and toilet, and also prevents access of the wires to the toilet seat user.

Figure 8A:
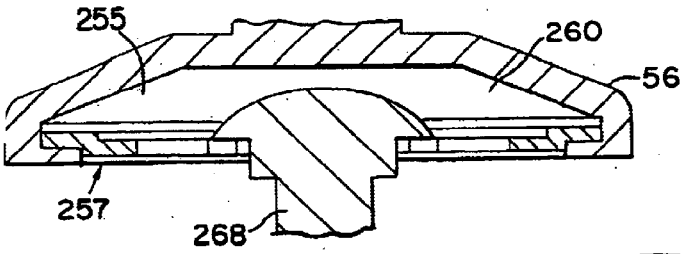
FIGS. 8*a–c* show a cross-sectional view of the toilet seat assembly component shown in FIG. 6 taken along line AA and lower elevation views of the toilet seat component of FIG. 6.
Figure 8B:
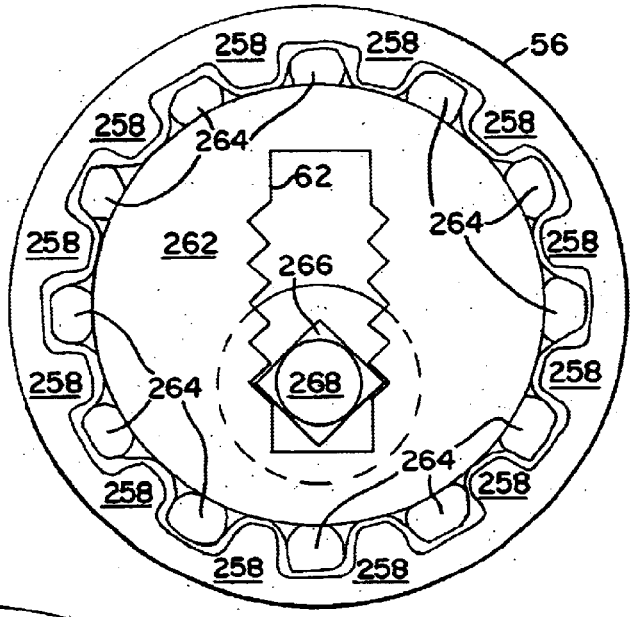
Figure 8C:
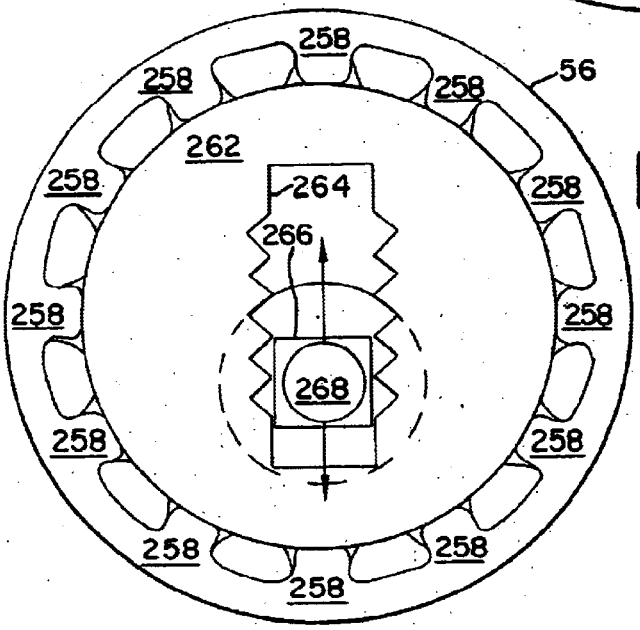
Figure 8D:
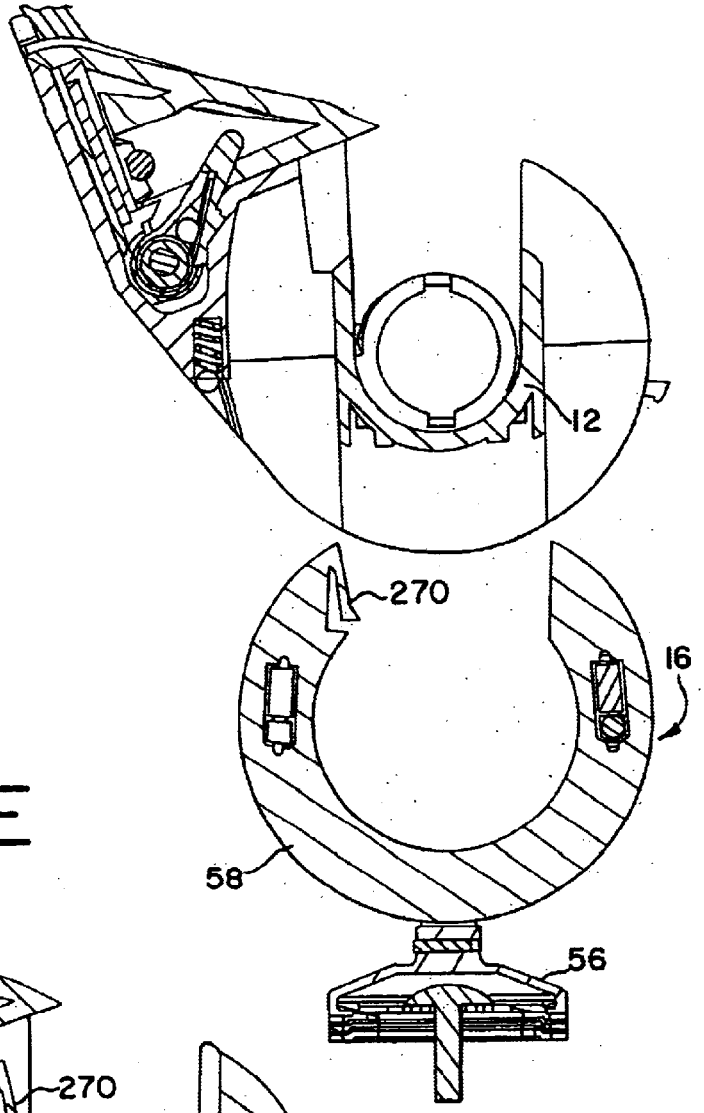
FIGS. 8*d–e* show a cross-sectional view of the toilet seat assembly components of FIG. 9 taken along line BB.

Another novel aspect of the present invention is shown in FIGS. 8*b–d*. Mounting fork assembly base 56 is substantially conical and defines and interior cavity 255 and an aperture 257. A series of teeth 258 circumferentially disposed around the perimeter of the aperture 257 extend inwardly and are coplanar with the bottom of the base 56. Biasing material 260, such as a spring or high density sponge, is disposed in the cavity 255 and is secured in place with the teeth 258. A substantially disc-shaped washer 262 comprising a series of washer teeth 264 disposed around the outer circumference of the washer 262. The washer teeth 264 are sized and positioned for mating engagement with the base teeth 258. The washer 262 is rotatable within the cavity 255 upon compression off the biasing material 260. The biasing material 260 otherwise secures the interlocking engagement of the base 56 and washer 262. A toothed slot 264 axially disposed across the washer 262 receives the cornered shoulders 266 of a bolt 268 that mates with an aperture (not shown) in the toilet surface to attach the mounting fork assembly to the toilet. In one embodiment of the invention the cornered shoulders 266 form 90° angles define a square. However, it is appreciated that in other embodiments the angle may be lesser or greater than 90°.

In operation, the bolt 268 and cornered shoulders 266 slidably engage the toothed slot 264 to provide for fine adjustment of the placement of the mounting assembly with respect to the toilet bowl surface. The distance between bolts of a first and second mounting assembly can, in this way, be varied to accommodate various mounting apertures on toilet bowl. The washer teeth 258 and the base teeth 264 align for telescopic insertion of the washer 262 into the cavity 255. When the washer 262 compresses biasing material 260, the washer 262 may be rotated enabling the washer teeth 264 to rotate within the cavity 255 and interlock with the base teeth 258.

Figure 8E:
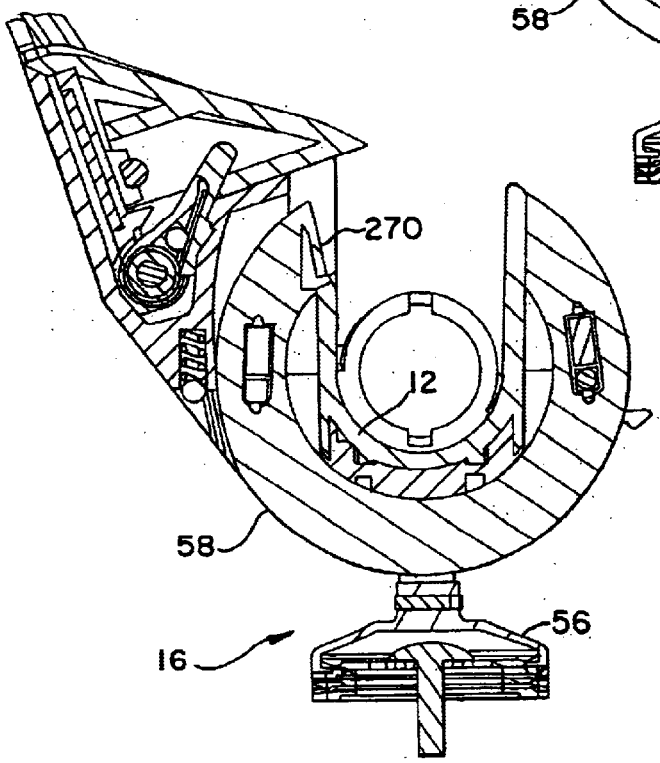

FIGS. 8*d–e* show an additional embodiment of the present invention incorporating a locking mechanism at the top of the mounting fork assembly. The locking member 270 acts as a leaf spring with its resting position away from the fork 58. The locking member 270 is cammed against its natural biasing as the lower housing 12 inserts within the fork 58. Once the lower housing 12 is in place, the locking member 270 returns to its original position and locks the lower housing 12 within the fork 58. Disassembly of the lower housing 12 and mounting fork requires depression of the locking member 270.

Figure 9:
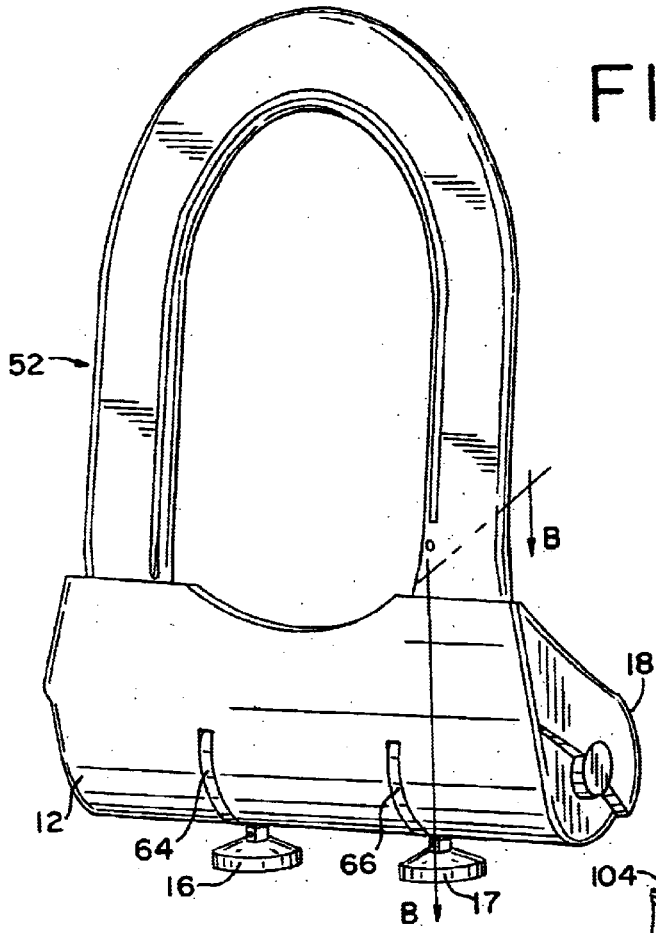
FIG. 9 shows a perspective view of the toilet seat assembly of FIG. 2.

Returning to FIGS. 4, 6–9, a plurality of channels running along the outside of the lower housing releasably receive the mounting fork assemblies enabling the entire assembly 10, including the seat assembly 52, to pivot upward (FIG. 9). This provides ease of cleaning of the underside of the assembly 10 and seat ring 26, as well as the toilet bowl surfaces. It is appreciated that these areas require daily or more frequent cleanings by cleaning personnel. The ability to rapidly pivot assembly 10 and seat ring 26 upward for cleaning saves the cleaning personnel substantial amount of cleaning time.

The channels 64, 66 are constructed to be substantially congruent to the fork portions 58, 58 to obtain a tight, rotatable fit. Optionally, a dry or wet lubricant is added to the channels 64, 66 to facilitate movement of the forks 58, 58. In another embodiment, the forks 58, 58 are constructed from a self-lubricating material, e.g. a self-lubricating plastic material.

FIGS. 4 and 7 show the lower housing 12. The interior of the lower housing 12 comprises a first and second wall 68, 70 that divide the interior into three cavities; the supply cavity 72, motor housing cavity 74, and take-up cavity 76. The supply and take-up cavities 72, 76 provide adequate volume for a supply roll of the anti-microbial plastic sleeve and a take-up roll of used sleeve. The motor housing assembly 54 (FIG. 5) fits neatly within the motor housing cavity 74.

U-shaped receptacles 78, 80 in the walls include a curved section 82, 84 and guide flats 86, 88 to receive and secure the motor housing assembly 54. The top portion of the each wall includes a channel 90, 92 that is continuous with a back wall channel 64, 66 on the outside of the lower housing 12. An aperture 94, 96 in each guide flat also leads to a back wall channel 64, 66. This construction enables the forks 58, 58 of the mounting fork assemblies 16, 17 to move freely within the interior of the cavity when the lower housing 12 and mounting fork assemblies 16, 17 mate and the lower housing 12 rotates. As will be discussed further, the rotation of the lower housing 12 causes the forks 58, 58 to further securely fasten the motor housing assembly 54 (FIG. 5) within the lower housing 12.

Figure 19:
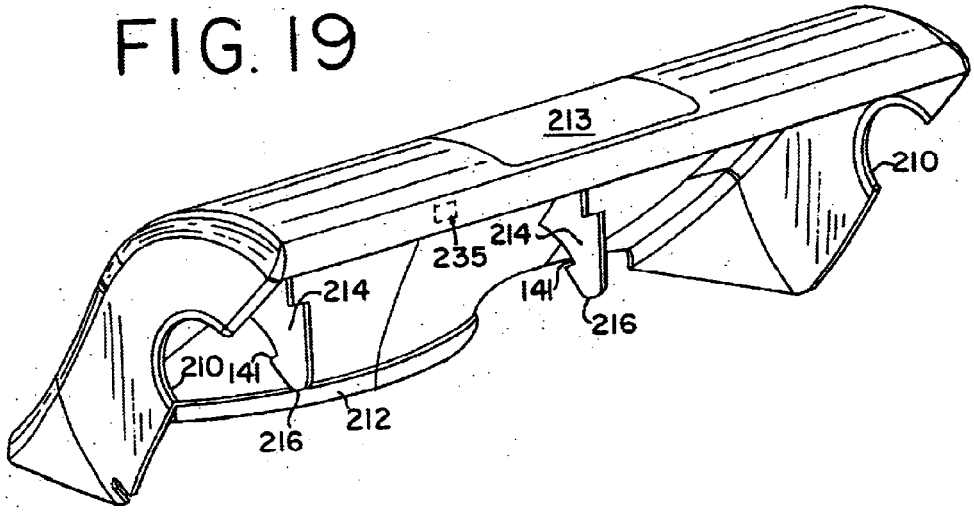
FIG. 19 shows a rear perspective view of a toilet seat assembly component of FIG. 5.

As is shown in FIG. 4, the top edges of the inner walls of the channels 90, 92 are rounded and follow the curvature of the interior of the outer cover 18 (FIG. 19). The outer walls of the channels 90, 92 are shorter and terminate into finger-like projections 98, 100 that are received by receptacles in the motor housing assembly 54 (FIG. 5) to further secure the motor housing assembly in place within the lower housing 12.

Lower housing 12 also includes bobbin ends 30, 32 integrally formed within the opposing sidewalls 40, 42. The bobbin ends 30, 32 are cylindrically shaped and serve a dual role. First, the outer cover 18 rotatably and releasably mounts to the lower housing 12 on the exterior surface of the bobbin ends 30, 32. The interior portions of the bobbin ends 30, 32 also hold the supply and take-up bobbin assemblies 20, 22 (FIG. 5) in place. The bobbin ends 30, 32 also include a molded cavity 102, 102 providing a space for a locking mechanism. It is also appreciated that the bobbin ends 30, 32 can be separate components that are received by apertures (not shown) in the sidewalls 40, 42. Exemplary materials for these bobbin ends include stainless steel, other anti-corrosive metals or plastic.

Figure 10A:
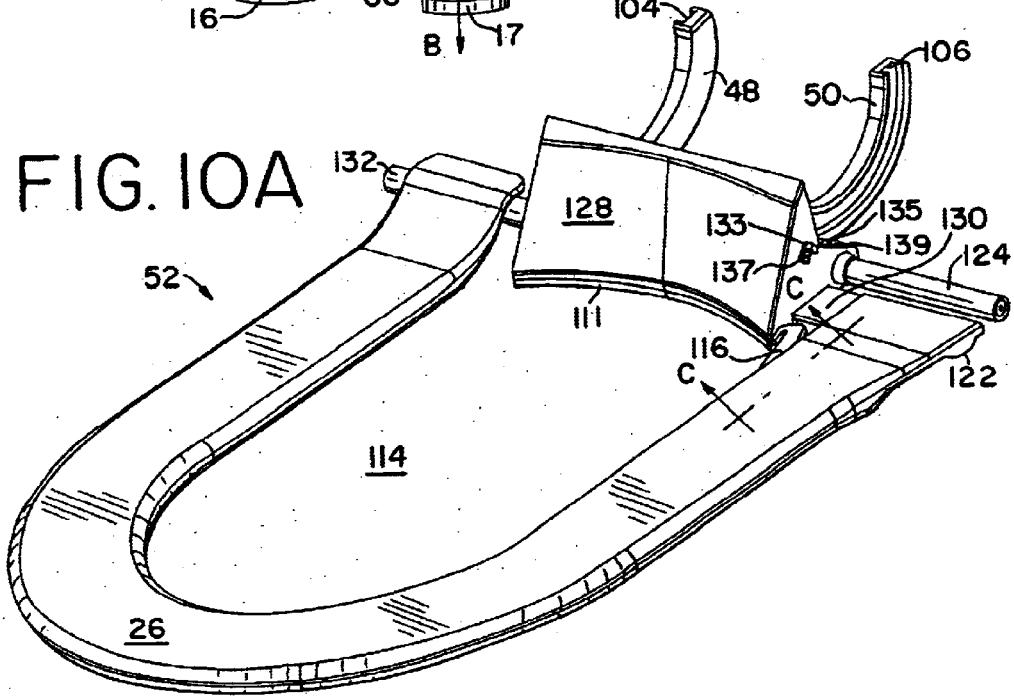
FIGS. 10*a–b* show front and rear perspective views of a toilet seat assembly component of FIG. 5.
Figure 10B:
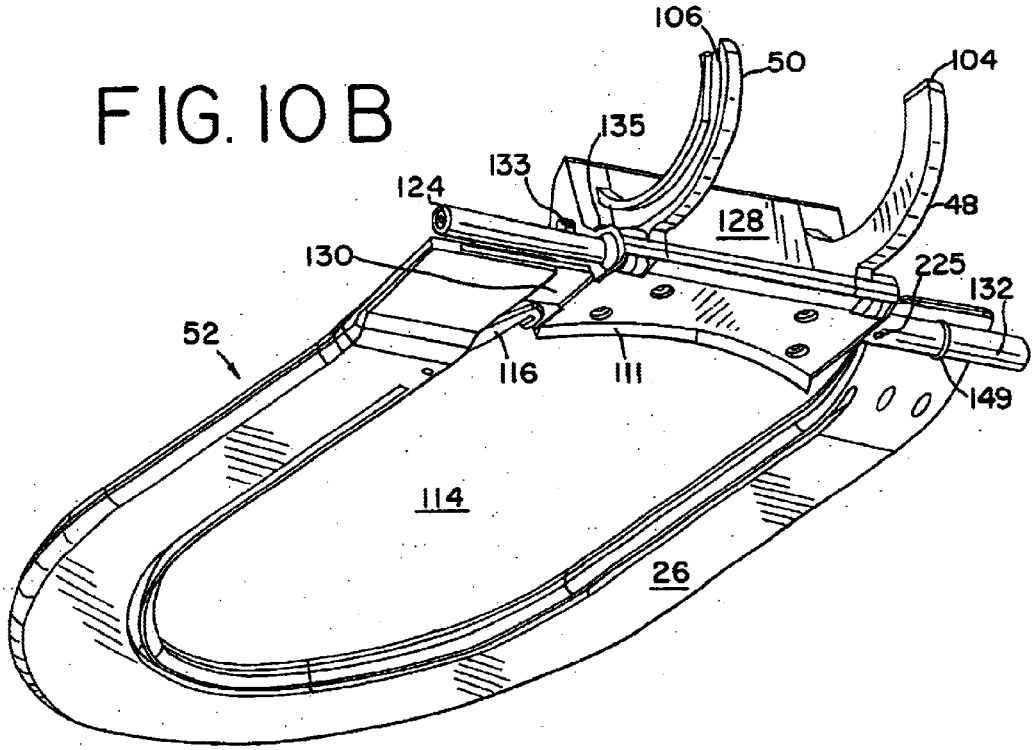

Referring to FIGS. 4 and 10*a–b*, the toilet seat arms 48, 50 include channels 104, 106 for town engaging corresponding guide ridges 108, 110 on the lower housing walls 68, 70. This arrangement releasably secures the seat assembly 52 to the lower housing 12. The provision of the channels 104, 106 and ridges 108, 110 also provides for easy assembly and disassembly of the seat assembly 52 from the assembly 10 for cleaning or other maintenance. A seat mounting lip 111 nests with a corresponding lip 112 on the lower housing 12 when the assembly 10 is assembled. The lip 111 is concave and defines a segment of an aperture 114 through which material can be deposited into the toilet bowl 14 (FIG. 1). The recessed lip 111 provides for a larger aperture as compared to conventional seats.

Prior to take-up on the take-up bobbin 22 (FIG. 5), the anti-microbial sleeve is slit and stretched to enable compact, tight rolling around the take-up bobbin. First, a tensioning knife 116 is disposed near the take-up end of the seat ring 26 and substantially in the middle thickness of the seat ring. The placement of the tensioning knife 116 is advantageous over the prior art because the sleeve is slit in even sections and rolls up consistently and tightly, without twisting.

Figure 11B:
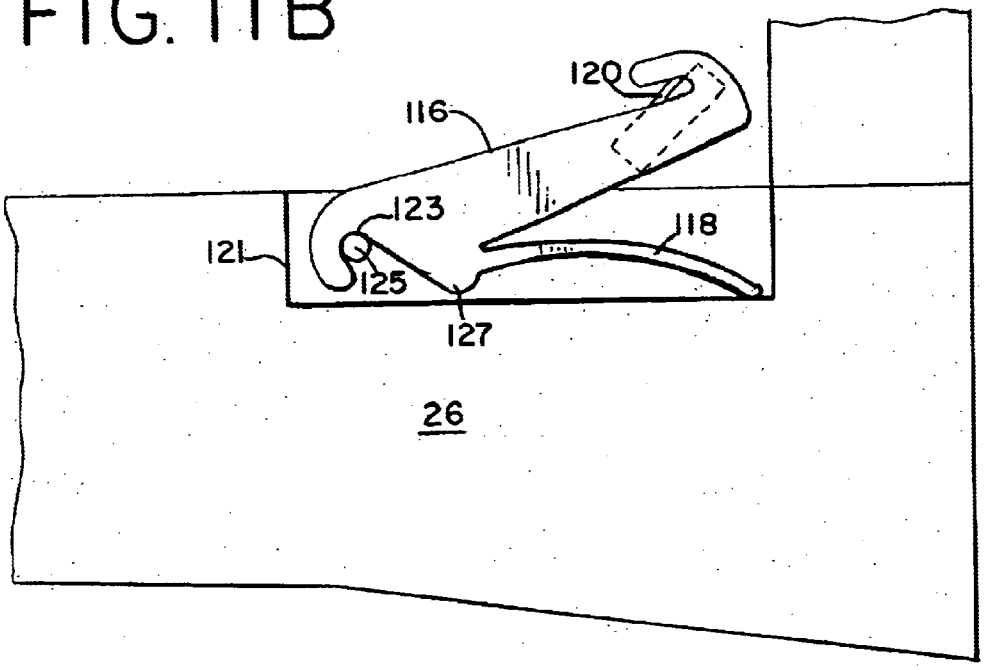
FIGS. 11*b–d* shows a cross-sectional view of the toilet seat assembly component of FIG. 11*a* taken along line CC of FIG. 10*a;*
Figure 11C:
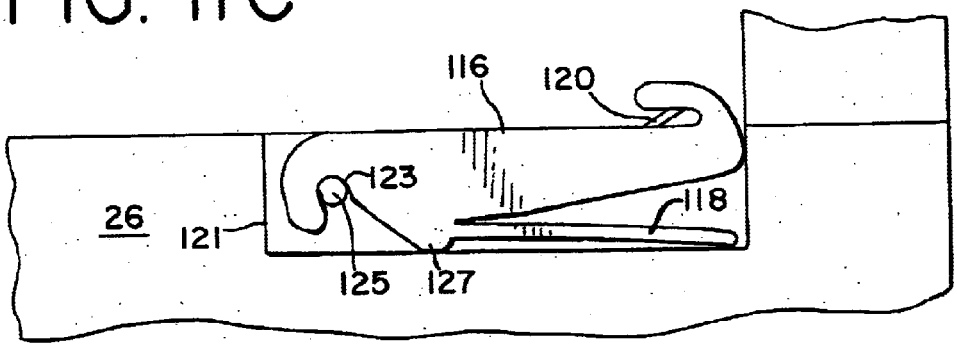
Figure 11D:
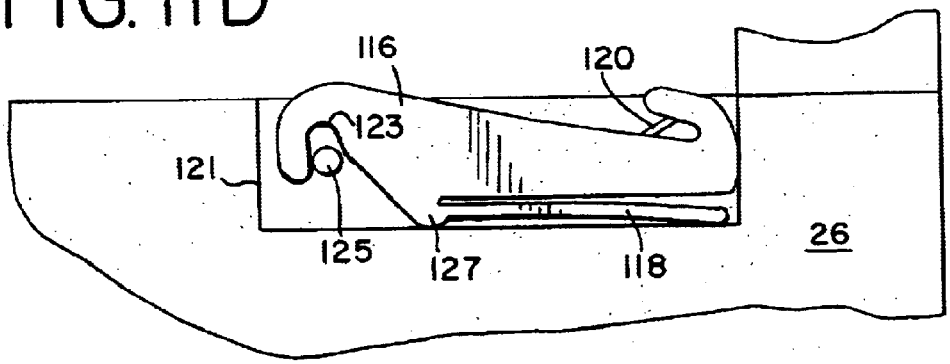
Figure 11A:
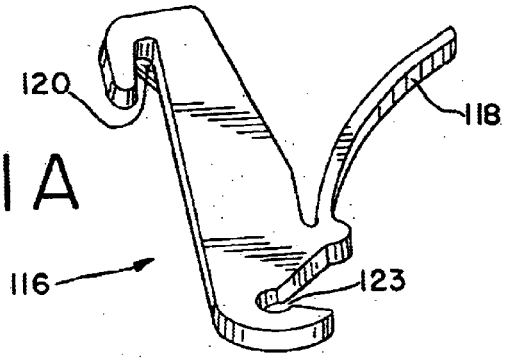
FIG. 11*a* shows a perspective view of a toilet seat assembly component of FIGS. 10*a–b;*

FIGS. 11*a–b* show the tensioning knife 116 in detail. The knife 116 is composed of a plastic or anti-corrosive metal and further includes a biasing arm 118 that keeps the knife edge 120 biased away from the seat ring 26. The knife 116 sits in a recess 121 in the seat 26. A recess 123 on the knife receives a hinge pin 125 on the seat ring to easily snap the tensioning knife 116 into place. The body of the tensioning knife 116 surrounds the blade 120, thereby preventing exposure to toilet seat users. It is also appreciated that when the upper cover 18 is lowered, the blade 120 is covered to further prevent exposure to the toilet seat user.

Additionally, the knife 116 is easily removed from the seat ring 26 by the presence of a pivot edge 127. The tensioning knife 116 is easily removed by pressing the blade end towards the seat ring 26 against the biasing arm 118. The pivot section 127 acts as a lever about which the knife 116 rotates until the engagement of the recess 123 and the hinge pin 125 is severed enabling the knife 116 to slip out of the seat ring 26. The force required to overcome the biasing arm 118 and release the knife 116 is greater than the force of the passing sleeve on the biasing arm 118. This prevents the knife 116 from become disengaged and falling out during operation of the assembly 10.

In another embodiment of the invention, a second tensioning element 122 disposed on the opposite side of the seat ring 26 from the tensioning knife 116 operates to stretch the anti-microbial sleeve after it is slit by the tensioning knife 116. The second tensioning element or "flexible finger" 122 also includes a biasing arm (not shown) to bias the finger away from the seat ring 26. It is appreciated that the location of the tensioning knife 116 and finger 122 prevent twisting of the sleeve as it travels around the seat ring 26. It is also appreciated that springs or other means can also be used with the knife 116 or finger 122 to achieve the desired biasing.

Also at the take-up end of the seat is a take-up fixed pin 124 over which the anti-microbial sleeve travels prior to winding on the take-up bobbin. The pin provides the assembly with a number of advantages. First, the pin brings together the cut and stretched portion of the sleeve and deflects it onto the take-up bobbin. The pin also acts as a "squeegee" taking up waste material and fluids from the top surface of the sleeve. As such, the sleeve is substantially clean as it is wound up on the take-up bobbin. Consequently, more used sleeve can be wound around the bobbin than in conventional systems. This arrangement also requires less maintenance.

Additionally, the pin 124 is a friction creating pin and, as is shown in FIGS. 10*a–b* and 12, the pin 124 is rotatably and eccentrically mounted on an axle 126. The frictional forces created between the pin 124 and advancing sleeve will also stabilize the sleeve further enabling it to roll-up consistently on the take-up bobbin without twisting. The eccentric mounting enables fine-tuning of the amount of tension applied to the top and bottom portions of the sleeve after it is slit by the knife 116. Equal amounts of tension are required to prevent the sleeve from twisting as it is rolled onto the take-up bobbin.

The placement of the take-up pin 124 demonstrates another important aspect of the invention. Because the pin 124 is mounted to the seat assembly 52, the assembly 10 will function properly when the outer cover 18 is raised, such as for maintenance. This feature is advantageous over other toilet seat assemblies that include a structure performing some of the tasks of take-up pin 124. These structures are mounted to the outer cover and, therefore, do not participate in operation of the toilet seat assembly when the outer cover is raised.

It is appreciated that the combination of the features of the tensioning knife 116 and take-up pin 124 offer substantial advancements over the prior art regarding the preventing loose rolling and twisting of the sleeve as it is rolled up on the take-up bobbin. However, it is also appreciated that either the tensioning knife 116 or take-up pin 124 acting alone would also offer an advancement over the prior art in preventing the twisting and loose rolling of the sleeve on the take-up bobbin.

Figure 10C:
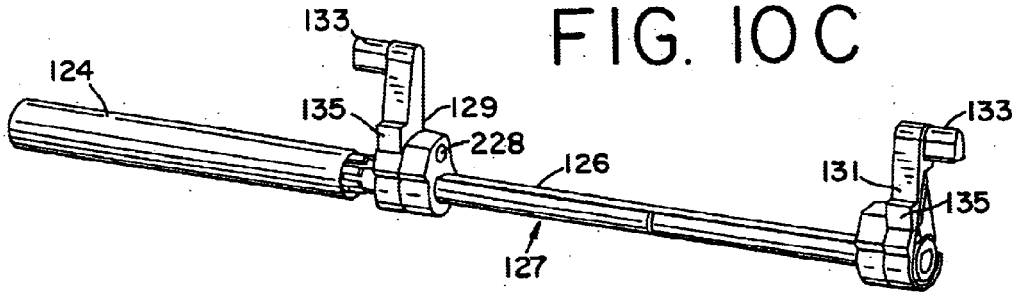
FIG. 10*c* shows a perspective view of a toilet seat assembly component of FIGS. 10*a–b;*
Figure 12A:
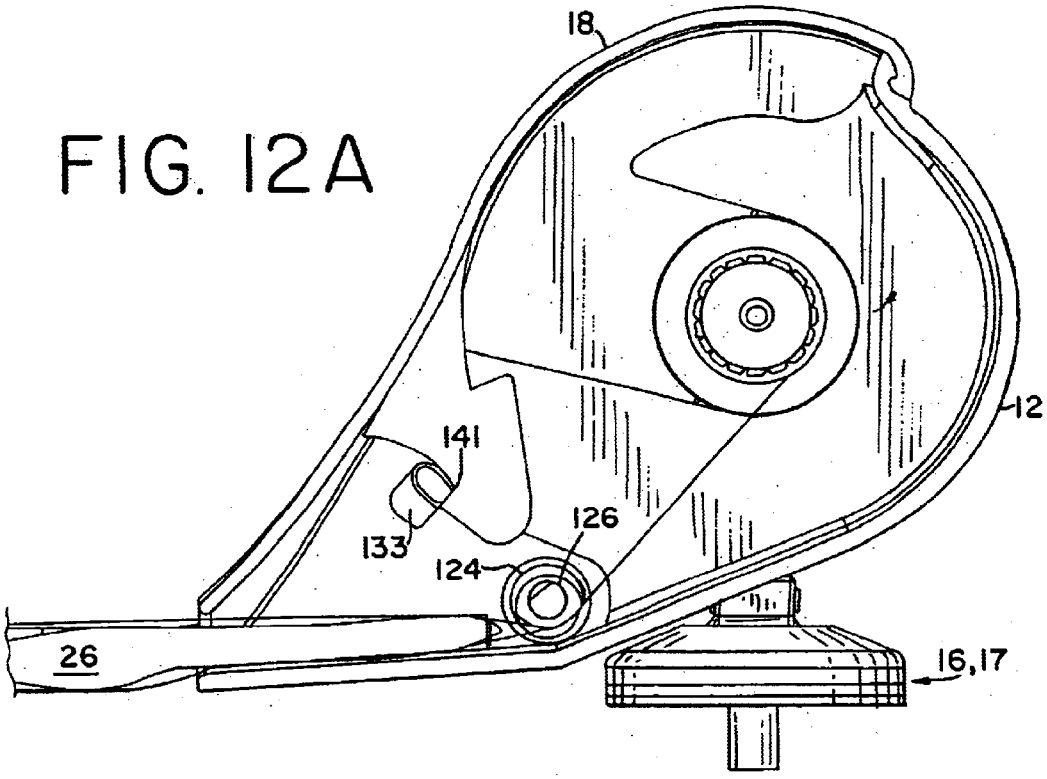
FIG. 12*a* shows a cross-sectional view of the toilet seat assembly taken along line DD of FIG. 2.

The axle 126 on which the take-up pin 124 mounts extends through the base 128 and comprises part of the central locking mechanism 127. FIG. 10*c* shows the central locking mechanism in detail. Members 129, 131 mount on the axle 126 and are spaced to fit within the base 128. Each member contains a first and second latch 133, 135. The first latches 133, 133 extend through the walls of the base in channels 137 (FIG. 10*a*), and engage the interior of the outer housing at lock ridge 141 (FIG. 12*a*). The second set of latches 135, 135 extends through the back of the base 128 to engage locking ridges 143 (FIGS. 4, 12*b*) disposed on the walls 68, 70 of the lower housing 12 (FIG. 4) to secure the seat assembly in place. Rotating the axle 126 disengages the first latches 133 from the lock ridges 141, enabling the cover to rotate upwards. Rotating the axle 126 also disengages the second latches 135 from the lock ridges 141 on the lower housing 12, enabling the seat assembly 52 to rotate upwards. In one embodiment of the invention, the central locking mechanism 127 is actuated by a screw with a custom-keyed screw head. It is also appreciated that rotating the outer cover upwards exposes the first set of latches enabling manual actuation of the mechanism to release the seat assembly locks 135, 135.

The seat ring 26 is substantially biased up away from the toilet bowl 14 to ease travel of the sleeve when the seat is not in use. The biasing is obtained by the dimension and construction of the toilet seat arms 48, 50. Frictional forces generated at the interface between the seat arms and rides (FIG. 4) maintain the seat ring 26 in a desired position. Preferably, there are two seat arms. However, it is appreciated that either a single arm appropriately sized and constructed, or a plurality of seat can be used with the assembly 10. The seat assembly base portion 128 also secures the motor housing assembly 54 in place when the seat assembly 52 and lower housing 12 mate.

Figure 12B:
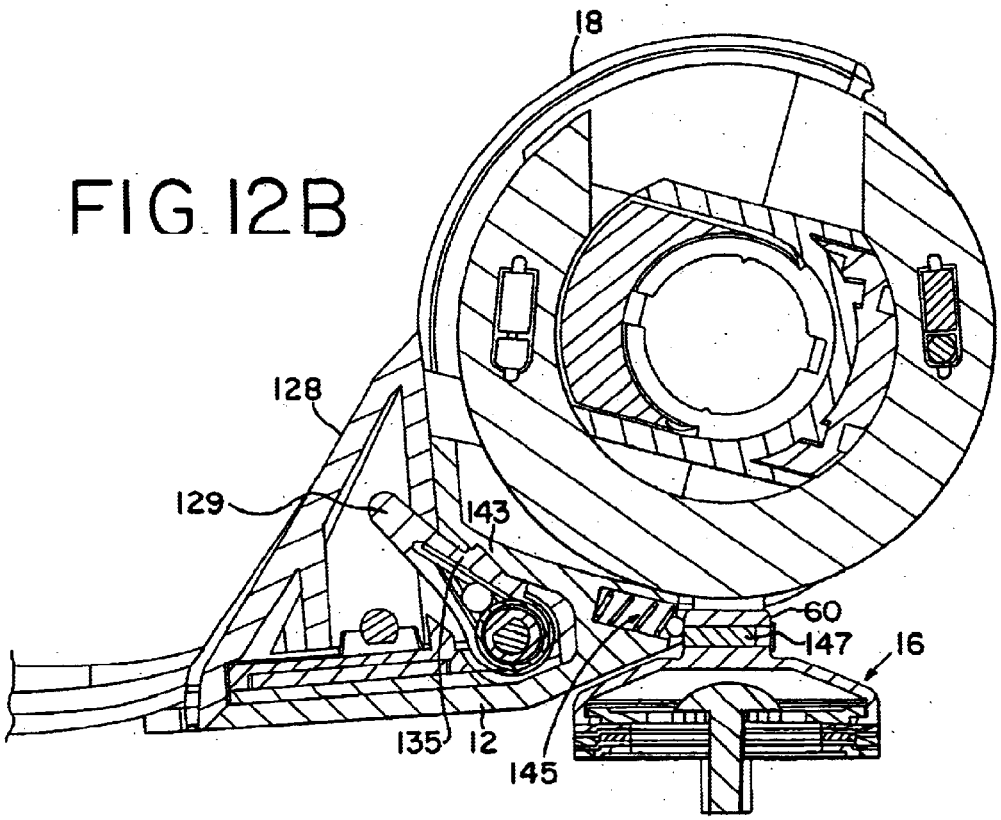
FIG. 12*b* shows a cross-sectional view of the toilet seat assembly taken along line EE of FIG. 2.

Additionally, a seat ring adjustment assembly variably adjusts the height of the toilet seat ring. As is seen in FIG. 12*b*, this assembly comprises a spring-loaded plunger 145 disposed in the lower housing 12. Rotation of the assembly downwards is restricted by the plunger 145 contacting a set screw 147 disposed in the threaded receptacle 60 in the mounting fork assembly 16. Adjusting the distance the set screw 147 extends from the mounting fork assembly 16 fine tunes the height of the seat assembly 52 above the toilet bowl surface 14 to prevent the anti-microbial sleeve from contacting the toilet bowl surface. It is appreciated that associating the set screw with the mounting fork assembly enables a different toilet seat assembly to be mounted on the mounting fork assembly while maintaining the same space between the seat ring and toilet bowl surface.

Returning to FIGS. 10*a–b*, the seat ring 26 attaches to the base 128 at bracket 130 on the take-up end of the assembly 52. Roller 132 extends from the side of the base 128 at the supply side of the assembly 52 and serves a dual purpose. First, the roller 132 and an O-ring 149 disposed around the roller 132 assist in preventing the anti-microbial sleeve from twisting as it unrolls from the supply bobbin by pressing the sleeve against the bottom of the contoured end of the seat ring 26. Second, when the seat assembly 52 is loaded, i.e. a user is sitting on the seat ring 26, the roller 132 supports the end of the seat ring 26 and prevents the bracket from overloading with torque and fatiguing or failing.

Referring back to FIG. 5, the motor assembly 54 comprises a motor housing 134, faceplate 136, outer cover 138 and battery unit 140. These components are shown in greater detail in FIGS. 4, 13–15. The motor assembly 54 is received by the receptacles 78, 80 and nests within the lower housing 12. Guide flats 86, 88 at the front of the receptacles 78, 80 guide the motor housing 134 into position and hold the motor housing 134 in place once the assembly 10 is fully assembled. During assembly, the receptacles receive the shoulders 78, 80 disposed on opposite sides of the housing 134. The contour of the housing back wall 146 mirrors that of the interior of the lower housing 24 enabling the motor assembly housing 134 to mount flush within the lower housing 12. Additionally, when the housing 134 is securely in place, the apertures 94, 96 in guide flats 86, 88 are left uncovered by the shoulders 142, 144 for receiving a portion of the mounting forks 58 (FIG. 6) during mating of the mounting fork assemblies 16, 17 and the lower housing 12.

The faceplate 136 adheres into place on the front of the motor housing 134. Receptacles 148 in the faceplate receive the finger-like projections 98, 100 of the lower housing walls 68, 70. The U-shaped construction of the shoulders their corresponding receptacles, along with the finger-like projection receptacles, eliminate unwanted rotation of the motor housing 134 during operation of the assembly 10.

It is appreciated that the contour of the faceplate 136 mirrors that of the interior wall of the outer cover enabling the components to fit together flush. Extensions 149 on the shoulders 142, 144 and the interior surface of the faceplate front wall 150 define a channel that receives a segment of the fork 58 of the mounting fork assemblies 16, 17 (FIG. 6) during assembly. The faceplate 136 also includes mounts 152, 154 for a motor housing display and motor actuation sensor.

The motor cover 138 hermetically seals a motor module, comprising an electric motor (not shown), circuitry, the motor housing display, and various sensors, including a motor actuation sensor. The motor cover 138 is preferably composed from a transparent or translucent plastic material to enable operation of the motor actuation sensor and viewing of the motor housing display. The electric motor is preferably a direct current motor. However, it is contemplated that a stepper motor or an AC motor can be used with implementation of appropriate electrical safeguards. A disposable or, preferably, a rechargeable battery 140 powers the motor. The circuitry used herein can also include a universal AC/DC power input, e.g. battery and transformer.

Figure 13:
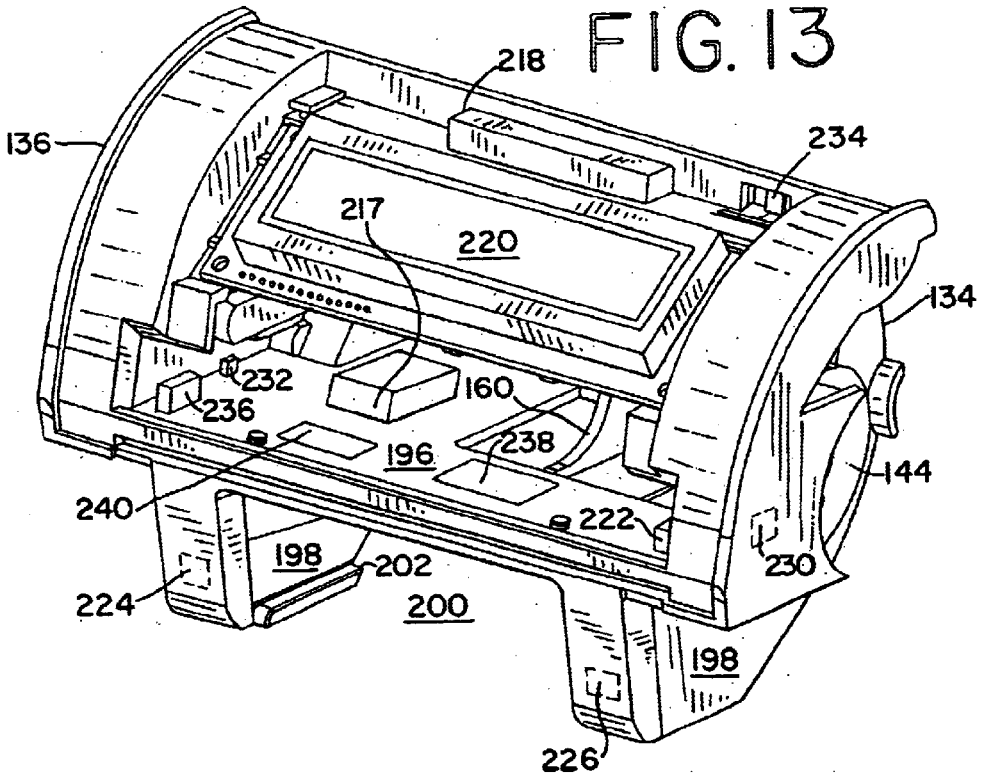
FIG. 13 shows a front perspective view of toilet seat assembly components of FIG. 5.
Figure 14:
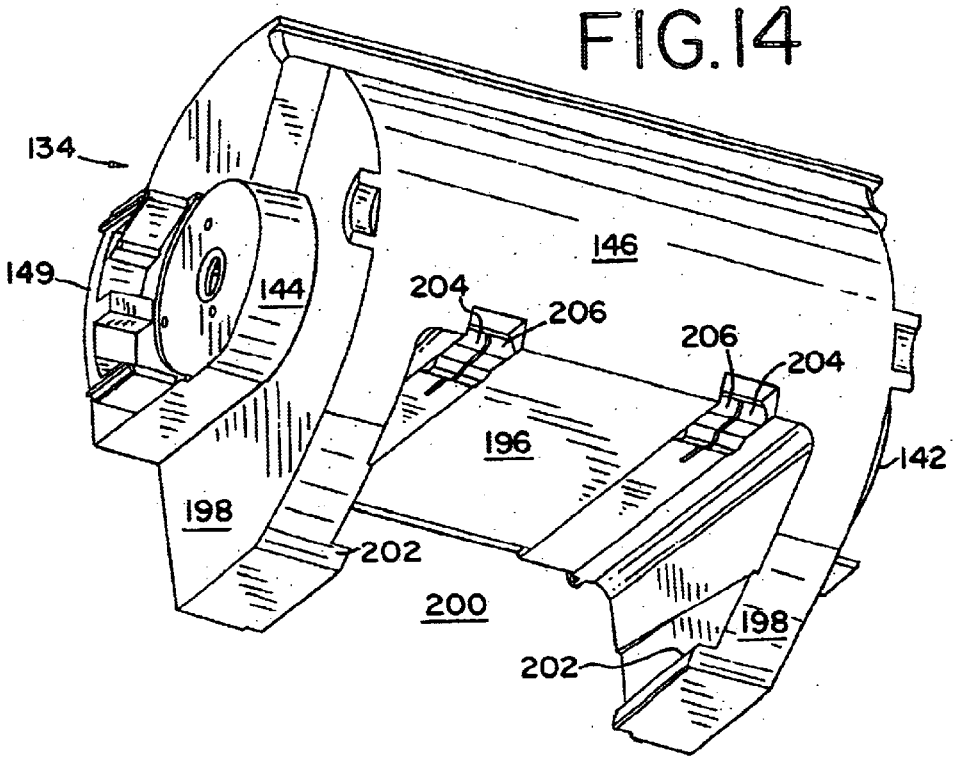
FIG. 14 shows a rear perspective view of a toilet seat assembly component of FIG. 5.
Figure 15:
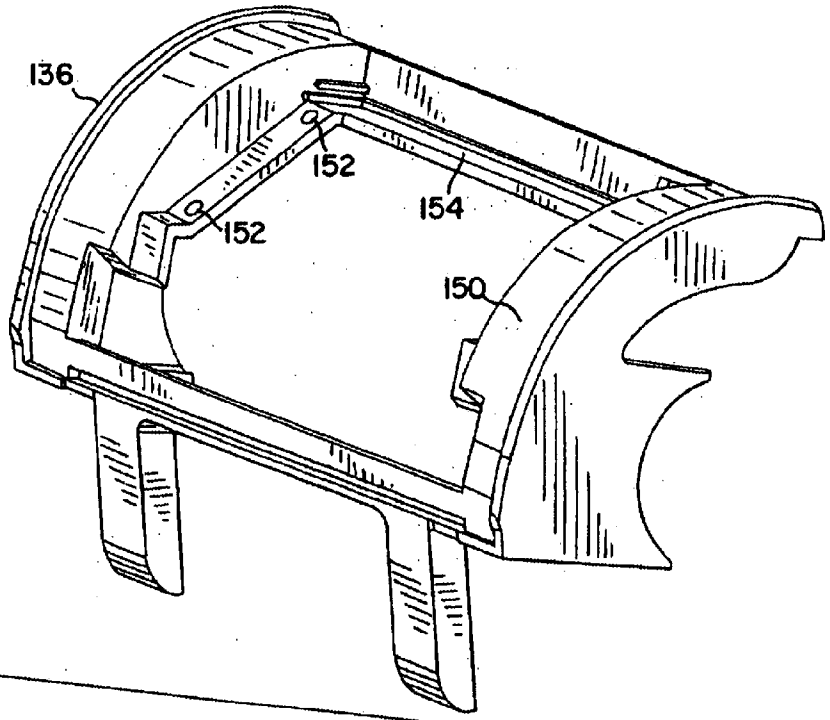
FIG. 15 shows a front perspective view of a toilet seat assembly component of FIG. 5.
Figure 16:
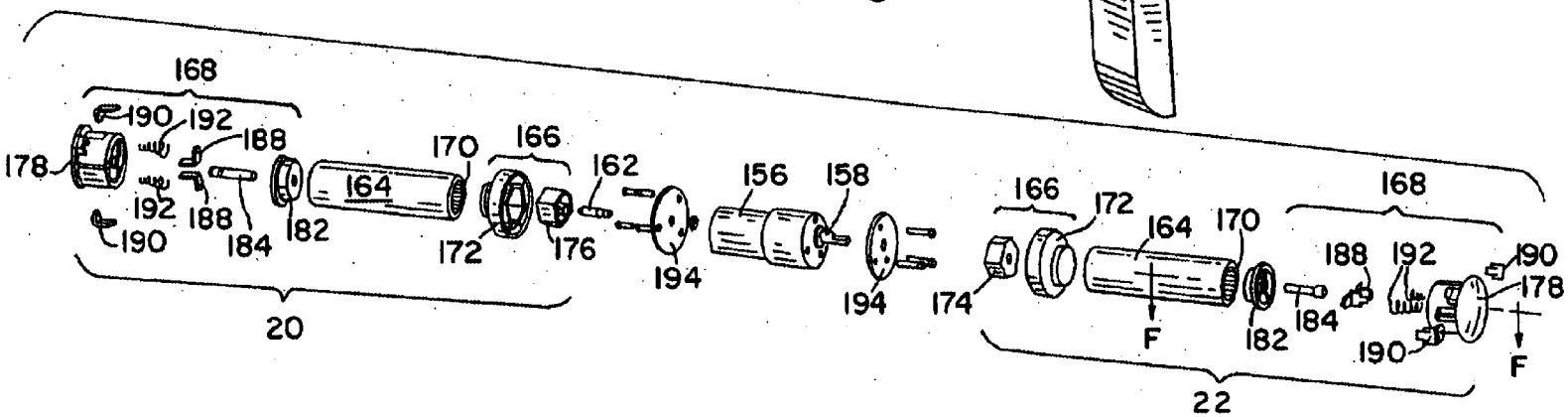
FIG. 16 shows an exploded perspective view of toilet seat assembly components of FIG. 5.

FIG. 16 shows and exploded view of the supply and take-up bobbin assemblies 20, 22. The motor 156 mechanically couples to the take-up bobbin assembly 22 via an appropriate driving means to supply the appropriate torque, e.g. a transmission or a drive shaft 158. The motor is removably mounted to the motor housing 134 at bracket 160 (FIG. 13). A second shaft 162 mounts to the motor 156 opposite the drive shaft end and is mechanically coupled to the supply bobbin assembly 20. However, the second shaft 162 is not driven by motor 156 and allows the supply bobbin assembly 20 to rotate freely.

The bobbin assemblies comprise a bobbin 164, coupling assembly 166 and end cap assembly 168. It is preferred that the bobbins 164 comprise a plurality of symmetrically disposed splines 170 on the interior surface. The splines 170 may also serve as drive teeth that mate with the coupling assemblies 166. It is appreciated that only the end portions of the splines engage the coupling assemblies 166. The splines 170 are reinforced to provide for lightweight, strong bobbins 164 that may be made from a disposable plastic material or disposable paper material. The bobbins are extruded from a thermoplastic material.

In another variant of the present invention, the bobbins 164 can be made from a recyclable material. It is appreciated that the invention broadly describes an inside surface-driven bobbin. The geometric configuration of the inside surface of the extruded bobbins can vary considerably while still accomplishing the desirable ability of the bobbin to be driven in its interior. Spline configurations and geometries can also vary. The inside surface can take the shape of a hollow square, triangle, octagon, hexagon, or any other geometric shape.

Although the coupling assemblies 166, 166 are both constructed to mate with the motor 156, only the take-up bobbin is actually power by the motor. The coupling assemblies comprise a bobbin coupling 172 with drive teeth disposed on a first end that is constructed to mate with the bobbin drive teeth 170. A receptacle at the second end of the bobbin coupling is configured to receive a motor coupling 174, 176 that, in turn, is configured to receive either the drive shaft 158 when the bobbin assembly is in the take-up position or the free-spinning shaft 162 when the bobbin assembly is in the supply position. Preferably, the motor coupling 174 driven by the motor 156 is constructed from metal and is removably attached to the shaft 158 with a set screw. The motor coupling 176 on the free-spinning shaft 162 may be constructed from a plastic or other suitable material. It is appreciated that this is the only point of variation among the supply and take-up bobbin assemblies 20, 22.

Additionally, a series of magnets (not shown) are disposed equidistantly around the couplings to actuate magnetic sensors monitoring the rotational velocities of the supply bobbin and take-up bobbin, as is described in detail later. Preferably four magnets spaced 90° are used on each coupling. However, any number of magnets may be used, provided equidistant spacing is maintained.

Figure 17A:
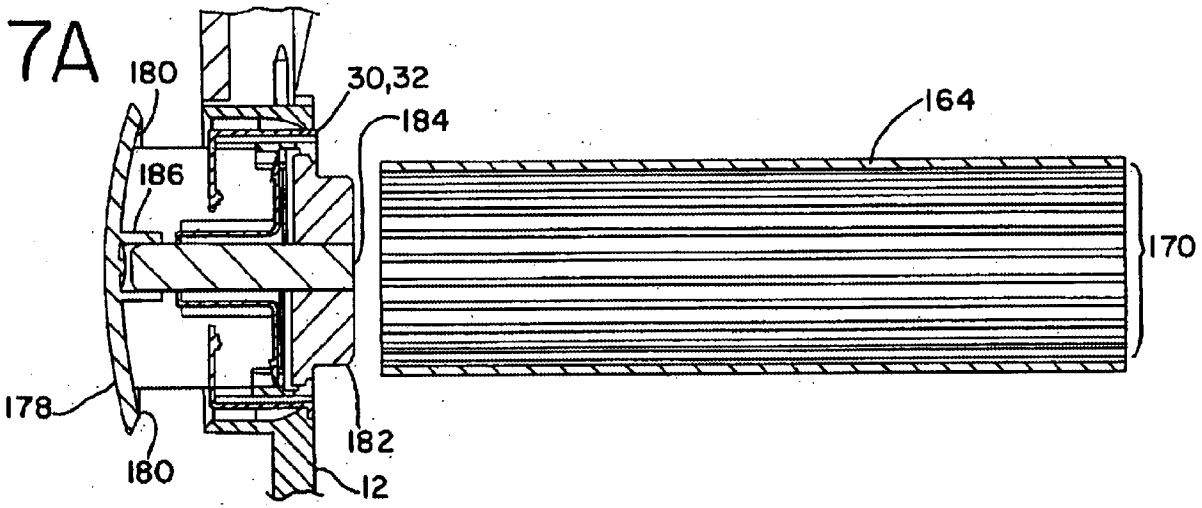
FIGS. 17*a–b* show cross-sectional view of toilet seat assembly components taken along line EE of FIG. 16.
Figure 17B:
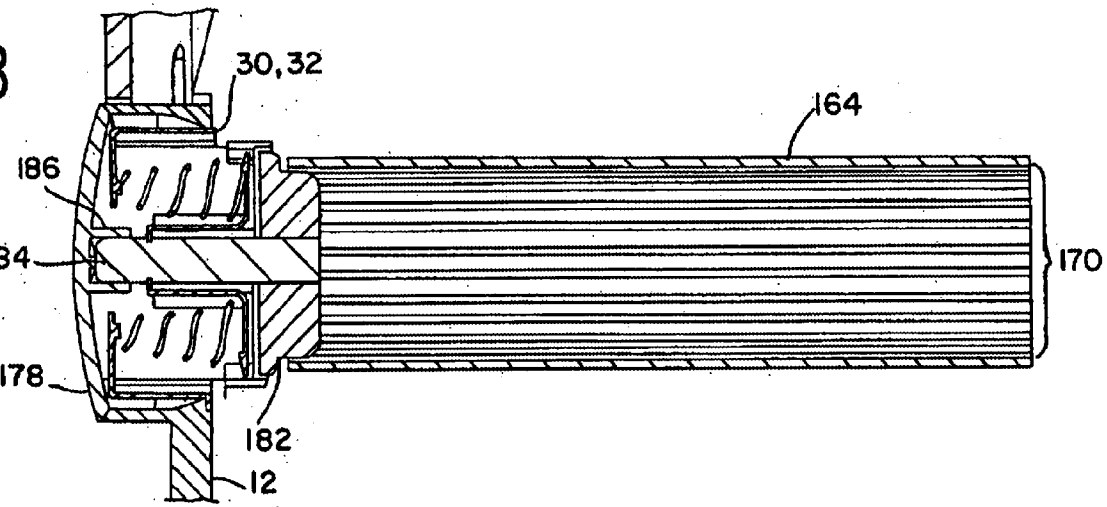

The end cap assembly 168 securely holds the second end of the bobbin assembly 20, 22 in place during operation. As is shown in FIGS. 16 and 17*a–b*, the assembly 168 is movably disposed in the lower housing 12 and inserts through the bobbin end 30, 32 to rotatably mate with the bobbin 164. The assembly comprises the end cap 178 with a first end that inserts through the bobbin end 30, 32 and a second, lipped end 180 that overlaps the bobbin end to hold the end cap assembly 168 in place within the bobbin end. A coupling 182 rotatably attaches to a first end an axle 184 mounted in a receptacle 186 in the interior of the end cap 178.

In one variant of the invention, the coupling 182 rotates freely on the axle 184 and includes teeth to engage the bobbin teeth 170 or is dimensioned to frictionally fit within the interior of the bobbin 164. In another variant, the axle 184 may rotate freely within the receptacle 186. Either variant provides support for the bobbin while allowing it to spin freely.

The end cap assembly 168 also includes a first and second set of clips 188, 190 and springs 192 to securely hold the end cap 168 in place and to spring bias the assembly inwards towards the bobbin 164 (FIG. 17*b*). Therefore, to remove the bobbin 164 requires access to the interior of the assembly to apply a force to the end cap assembly against the biasing of the spring (FIG. 17*a*). When the end cap assembly is manually actuated, it is substantially flush with the inside wall of the lower housing. Consequently, the take-up or supply bobbin may be easily removed to facilitate the cleaning of the take-up and supply cavities 72, 76 (FIG. 4).

The shafts 158, 162 communicate with the coupling assemblies 166, 166 through apertures (not shown) in the lower housing walls 68, 70 (FIG. 4). Washers 194, 194 are provided between the coupling assemblies 166, 166 and walls 68, 70 (FIG. 4) to prevent damage to the apertures from eccentric movement of the shafts 158, 162. It is appreciated that the washers 194, 194 would deform and would require repair or replacement prior to damaging the lower housing walls, consequently requiring replacement of the entire lower housing 12 (FIG. 4).

In another variant of the invention, the bobbins 164 include a single or plurality of O-rings (not shown). It is appreciated that use of the O-rings permits for the provision of more or less anti-microbial sleeve as desired. Generally the supply of sleeve will rest upon the O-rings. The O-rings are of variable thickness to accommodate the desired rates of supply of sleeve.

An important aspect of the invention, demonstrated in FIG. 16, is that the supply and take-up bobbin assemblies 20, 22 are virtually structurally identical, and, therefore, interchangeable. This enables an empty supply bobbin to be used as a take-up bobbin during the next operational cycle.

Returning to FIGS. 4, 13–14, the motor housing floor 196, protuberances 198, 198 and the floor of the lower housing 12 define a cavity 200 for neatly storing the battery unit 140 (FIG. 5). It is contemplated that the battery unit 140 may come in one or several pieces all fitting well within the cavity. Inwardly extending flanges 202, 202 at the ends of the protuberances hold the battery unit within the cavity 200. Contacts on the top of the unit communicate with contacts on the bottom of the motor housing 204, 204 to power the electrical components of the assembly 10. An additional set of contacts 206, 206 may also be used to recharge the battery. It is appreciated that the entire motor assembly (motor housing and battery) 54 can be readily removed from the assembly in a single piece for ease of servicing or replacement.

In an alternative embodiment, a desiccant dispenser nests in cavity 200 replacing the battery unit. The release of the desiccant could be coordinated with the movement of the sleeve, i.e. every time a new segment of sleeve is unrolled around the seat, a unit of desiccant is dispensed into the toilet bowl. In this arrangement, a battery unit is fit into the motor housing 134 or the assembly is from an external source.

Figure 18:
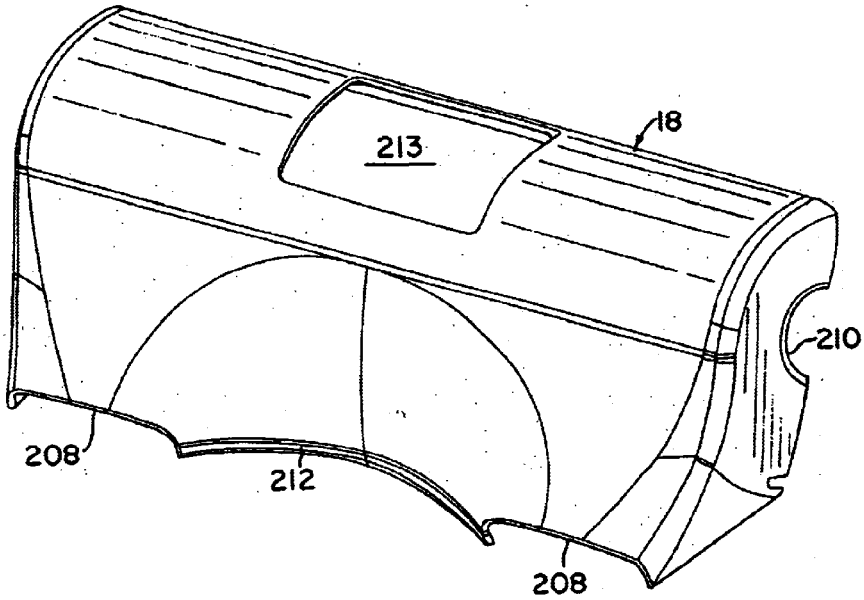
FIG. 18 shows a front perspective view of a toilet seat assembly component of FIG. 5.

The toilet set assembly 10 also includes an outer cover 18 that is shown in detail in FIGS. 18–19. The outer cover 18 rotatably connects to the lower housing 12, and rotates in relation to the lower housing 12 to expose the supply and take-up bobbin assemblies and the motor assembly. Recesses 208, 208 accommodate the toilet seat ends providing enough clearance for the anti-microbial sleeve to pass in and out of the outer cover 18 without snagging. It is also appreciated that the recesses 208, 208 protect the interior of the outer cover 18 from becoming contaminated with undesirable matter. The outer cover body 18 is generally cylindrical in shape, but can be any desired three-dimensional configuration. Semi-circular apertures 210, 210 are disposed on opposite ends of the body for ready mating and rotation of the outer cover 18 around the end bobbins 30, 32 of the lower housing 12 (FIG. 4).

The outer cover 18 also includes an outer lip 213. Outer lip restricts movement of toilet seat assembly upon contact of lip 213 with the top of the base portion of the mounting fork assemblies 16, 17. It is appreciated that this restricts the seat from undesirably contact with a wall or a tank of bowl. Additionally, the outer lip and lower housing back wall channels combination prevents undesirable lateral movement of the toilet seat assembly 10.

The outer cover 18 also includes a recessed segment and lip 212 that aligns with and nests over the toilet seat lip 111 (FIG. 10*a*) and the lower housing lip 112 (FIG. 4). This provides for the disposal of material more readily into the toilet bowl 14 (FIG. 1) and further limits the amount of material that enters the interior of the assembly 10. A transparent or translucent portion 213 aligns over the motor actuation sensor mount 154 (FIG. 15) on the faceplate to enable the motor actuation sensor to 'see' outside the assembly 10. It is also appreciated that the entire outer cover 18 may be composed of a transparent material to enable viewing of the internal mechanisms of the assembly.

As shown in FIGS. 12*a* and 19, the outer cover 18 is self-locking. Members 214, 214 disposed on the interior surface of the cover each have a locking recess or groove 141 which is engaged by a latch 133 of the central locking mechanism 127 (FIG. 10*c*). As the outer cover 18 rotates downward the cam surface 216, 216 on the members moves the latches within latch channels 137 (FIG. 10*a*) until the latches 133 snap into the locked position within the recess or groove 141 to snap the outer cover shut. The outer cover 18 also serves to lock the end bobbins 168 in place when the outer cover is closed by covering the locking pins (not shown) extending through recesses 102, 102 in the bobbin ends 30, 32 (FIG. 4).

Referring back to FIGS. 8*d–e*, a key aspect to the present inventive toilet seat assembly is the predetermined angle of assembly or assembly plane. The principle of operation of this feature is that if a component is rotated within the C-shaped mounting fork (or other component of the system) to an angle at which the component can be removed from the mounting fork, the component can be lifted up through channel. If component is rotated in either a clockwise or counterclockwise position, the mounting fork assembly locks component into place, preventing its removal from the assembly. For example, the remove the motor housing assembly from the motor housing cavity, the lower housing and mounting forks must be positioned such that the entrance to the U-shaped receptacles of the lower housing are aligned with the space between the fork ends. This enables the motor housing assembly to easily slide out of position.

It is also appreciated that forks can be replaced with other types of mounts that permit for hinged rotation of the seat assembly about an axis of rotation. The general concept behind these mounts is that the mounts are located substantially between bobbins and motor. These mounts can be a variety of geometric shapes. The rotatable construction of the toilet seat assembly also has the added advantage of flipping the entire assembly upwards to enable cleaning of the underside of the assembly and toilet surfaces below the assembly.

Another important aspect of the invention is a three point locking arrangement created by the structure of the components and the way they mate. One of the points of the locking system involves the use of the mounting fork assemblies, the second point involves the use of pins and locking mechanism described herein, and the third point involves the lips of the components. For example, lower housing 12 has lower housing lip 112 (FIG. 4), and outer cover 18 has outer cover lip 212 (FIG. 18). Lower housing lip 112 and outer cover lip 212 releasably lock together and provide a substantially water tight seal in one variant of the invention.

Referring back to FIG. 13, the present inventive toilet seat assembly employs a microprocessor 217, optical and magnetic sensors and a display 220 to ensure smooth operation of the unit and to provide maintenance persons and toilet users with necessary information about the unit. A motor actuation sensor 218 comprises a series of optical sensors. When the predetermined pattern of the sensors is triggered, the motor is actuated and a segment of anti-microbial sleeve advances around the seat ring. In one embodiment of the present invention, three optical sensors are linearly arranged. Triggering the middle sensor causes the sleeve to advance. However, the sleeve is not advanced if, for example, all of the sensors are triggered or a sensor other than the middle sensor is triggered. This check feature prevents accidental actuation of the motor, e.g. an article of clothing from a toilet seat user covers the sensor or a maintenance worker accidentally covers the sensor while cleaning the assembly. The motor actuation sensor 218 'sees' the outside through the outer cover window 218 (FIG. 18) and motor cover 138 (FIG. 5).

In another variant of the present invention, the outer cover 18 may include an optional electronic eye sensor mounted on the outer cover or other component thereof. The sensor may be microprocessor controlled or include other control operation circuitry. The electronic eye sensor actuates the motor to move the anti-microbial sleeve around the toilet seat. The motor is actuated upon the sensor sensing the upward or downward motion of an individual using the toilet seat assembly.

A second set of sensors are disposed on or within the motor housing 134 and faceplate 136 to monitor various operational characteristics of the assembly and provide data to the microprocessor 217. The microprocessor in combination with the motor and the various sensors described herein operate to continuously and automatically determine the amount of the anti-microbial sleeve on the supply bobbin and take-up bobbin and monitor the frequency of maintenance and repair of the assembly.

A first sensor 222 disposed in the in motor housing works in connection with a magnet 223 (FIG. 6) in the fork 58 to detect when someone is sitting on the toilet seat assembly 10. The sensor detects deflection of the assembly 10 and prevents the motor actuation sensor from causing the motor to advance the next segment of anti-microbial sleeve around the seat ring 26. This prevents excess and wasteful dispensing of the sleeve and further prevents jamming of the sleeve within the assembly.

The second sensor 224 monitors the amount of sleeve dispensed from the supply bobbin assembly 20 (FIG. 4) and is triggered by a magnet 225 (FIG. 10*b*) disposed on the roller 132 (FIG. 10*b*). The third sensor 226 monitors the actuation of the lock and is triggered by a magnet 228 (FIG. 10*c*) on the central locking assembly 127 (FIG. 10*c*). It appreciated that the second and third sensors 224, 226 are mounted within the motor housing protuberances 198, 198 behind the faceplate 136. The fourth and fifth sensors 230, 232 monitor the rotational velocity of the take-up and supply bobbins, respectively. The microprocessor uses data collected from the second, fourth and fifth sensors to calculate the amount of used sleeve on the take-up bobbin and unused sleeve remaining on the supply bobbin.

The sixth sensor 234 monitors the status of the outer cover 18 (FIG. 18), i.e. open or closed with magnet 235 and prevents the motor actuation sensor 218 from causing the motor to advance the sleeve when the outer cover 18 is open. It is also appreciated that when the sixth sensor 234 detects that the cover 18 is open, the optical sensors of the motor actuation sensor 218 may be used in a second capacity. Additionally, a radio frequency identification reader (RFID) 236 is also disposed on the interior of the motor housing 134. The RFID 236 reader receives a signal from a radio frequency chip 237 (FIG. 6) mounted in the fork 58 (FIG. 6). The RF chip 237 contains information about the location of the toilet, such as building address and stall location and number. As will be described in detail, the toilet location information is important to the monitoring features of the present inventive toilet seat assembly. It is also appreciated that in another preferred embodiment, the microprocessor 217 can be replaced by a logic circuit.

The display 220 is correlated to the microprocessor 217 (or logic circuit) and provides a visual indicator, such as an electronic bar graph or other graphical display. The display provides the operational status of the assembly (i.e., remaining amount of unused anti-microbial sleeve on the supply bobbin, amount of sleeve rolled on the take-up bobbin, battery status), operating instructions to the user, or identity information (address of building, stall location and number, etc.) of the toilet seat assembly. The display 220 can also provide other operational data, such as other readouts and information including date of last servicing or replacement of the components of the assembly 10, number of operation cycles of assembly 10, number of flushes, and other relevant statistical data. In another embodiment, the toilet seat assembly also includes a speaker and speaker circuitry for audibly providing a user with use instructions or information such as indicating that fresh sleeve has been dispensed on the seat ring 26.

A speed control circuit 238 maintains a predetermined or substantially constant motor speed, and consequently, rate of sleeve dispensing around the toilet seat regardless of the amount of sleeve on supply bobbin or take-up bobbin. It is appreciated that tearing of the sleeve is reduced, or even eliminated, by controlling the speed of the motor. Additionally, the invention also utilizes hardware and/or software 240 that provides for variable power provision to the motor, e.g. variable current limiting that is dependent on the amount of used sleeve on the take-up bobbin and the amount of current being drawn by the motor. For example, a smaller current is provided to motor when there is a small amount of used sleeve on take up bobbin, and a greater amount of amperage is provided to motor if there is a larger amount of used sleeve on take up bobbin.

Figure 20:
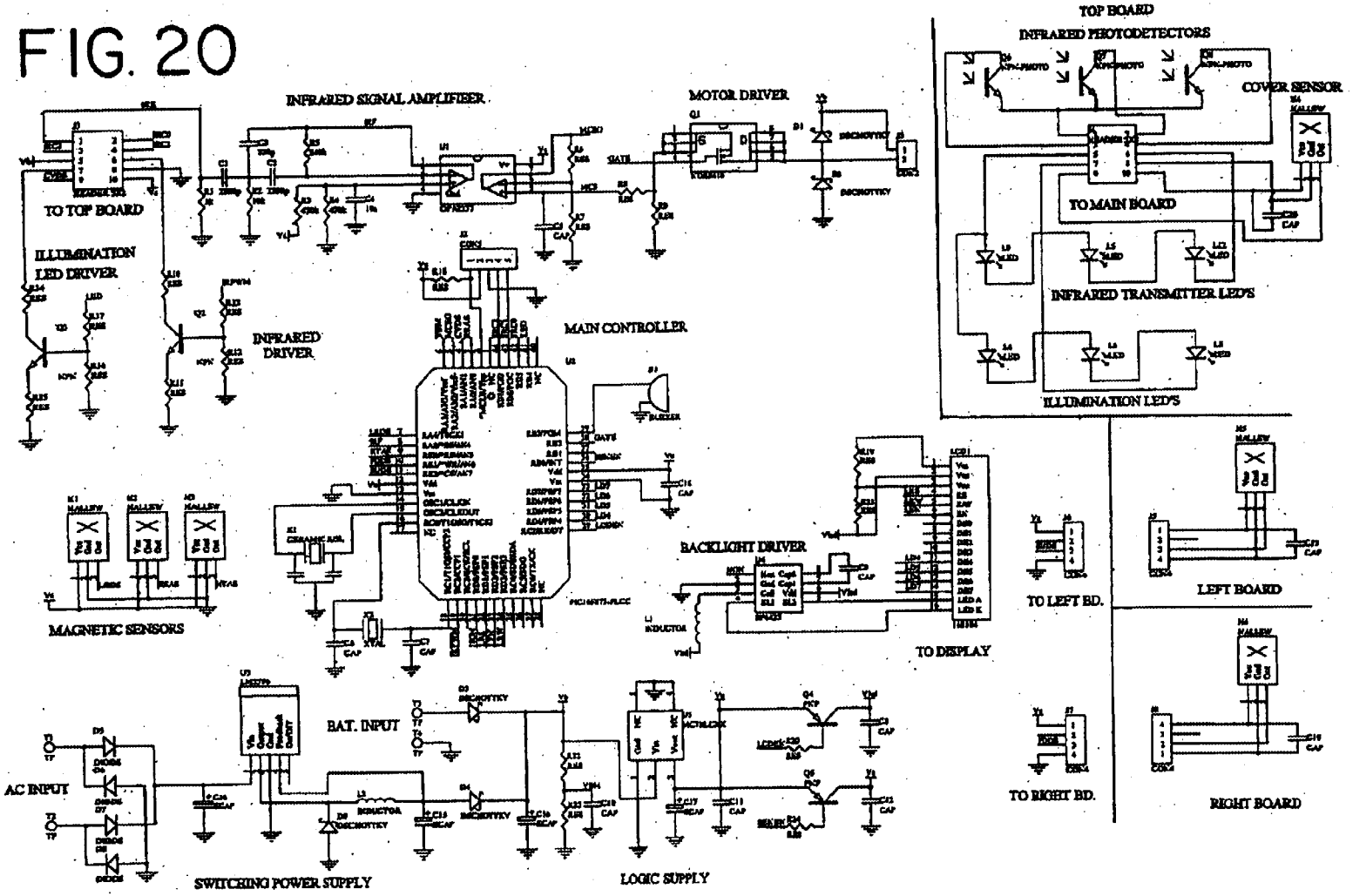
FIG. 20 shows a schematic diagram of the electrical components of the toilet seat assembly of FIG. 2.
Figure 21:
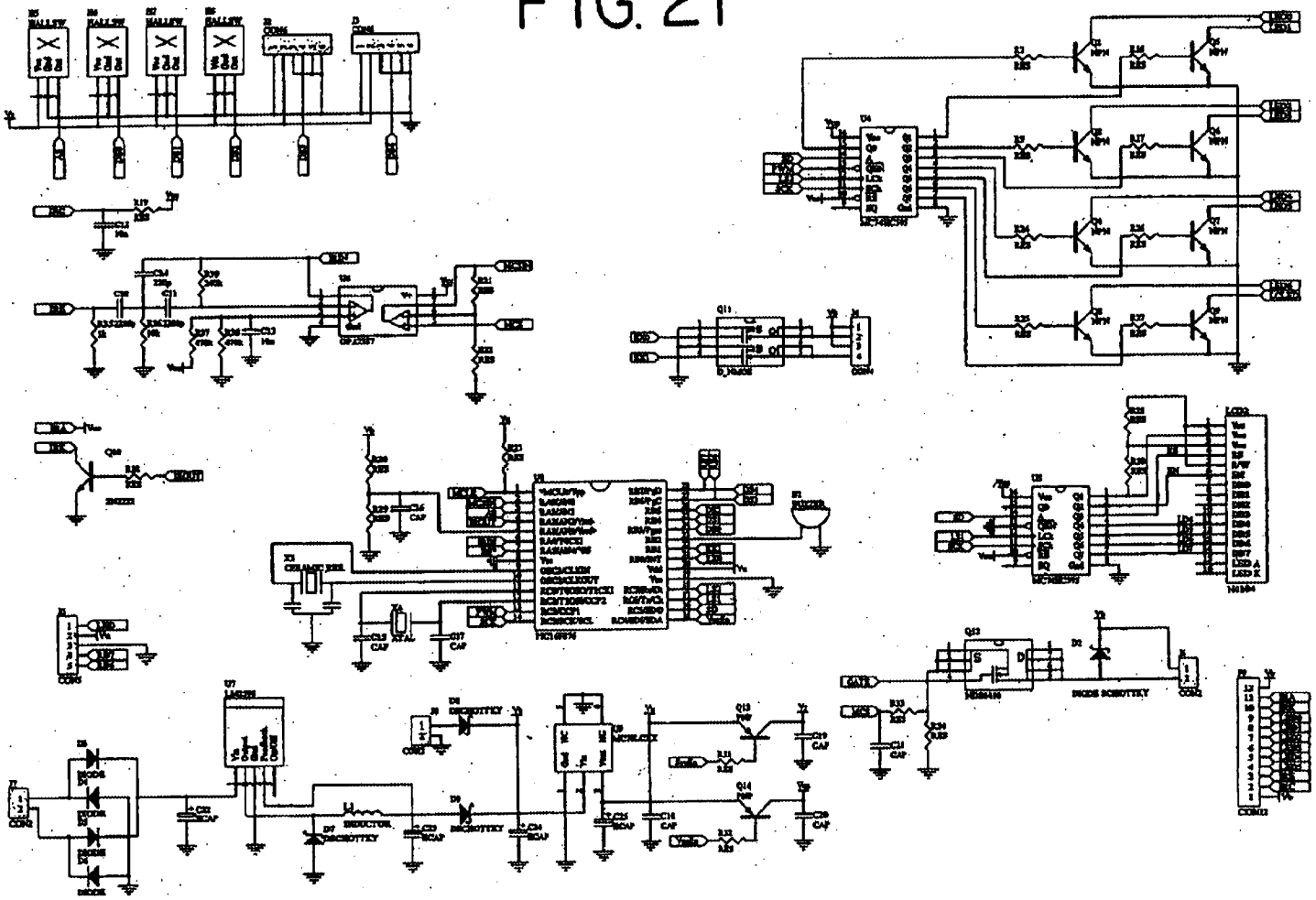
FIG. 21 shows a schematic diagram of the electrical components of toilet seat assembly of FIG. 2.

Additionally, if the motor draws current exceeding a predetermined threshold, such as in a situation where the sleeve is prevented from advancing by a toilet seat user sitting on the seat ring or someone holding the sleeve, the motor will shut down. It is appreciated that electrical power is variably delivered to motor based upon or as a function of the sensor inputs or other data input (supply bobbin data input) described herein using the hardware and software described herein. Reducing the amount of current supplied to the motor or shutting down the motor when an upper threshold for current is exceeded, ensures that the sleeve does not tear. FIGS. 20–21 schematically show the various circuits utilized by the microprocessor to operate the assembly 10.

Figure 22:
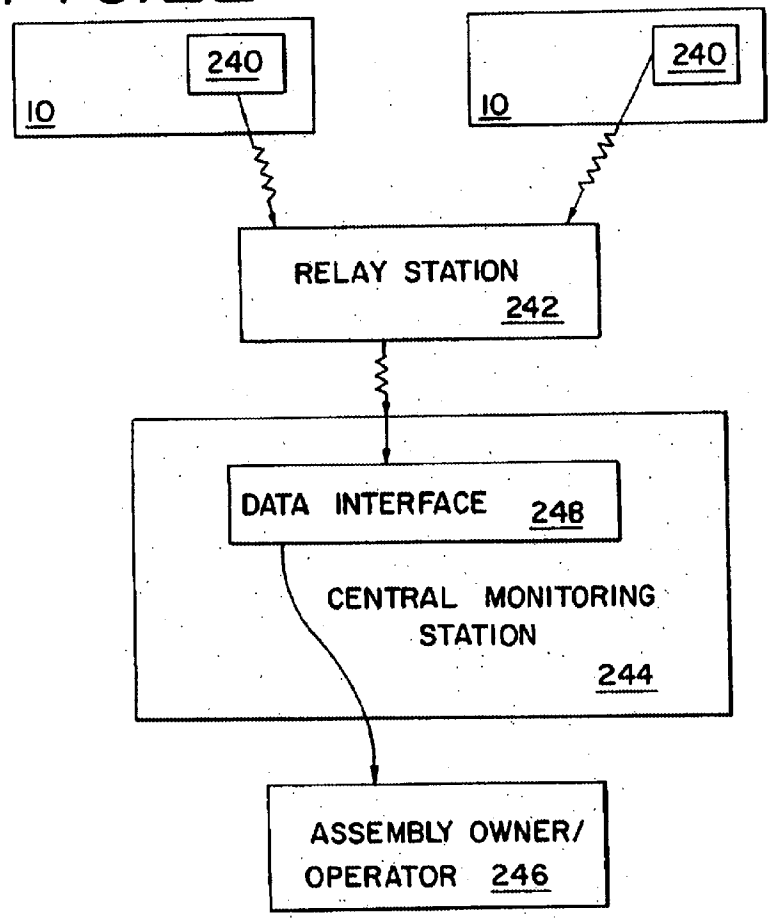
FIG. 22 shows a flow chart representation of the operation of the toilet seat assembly of FIG. 2.

Another aspect of the present invention is the ability of the toilet set assembly to transmit the operational status data of the assembly to a remote computer system for continued monitoring. FIG. 22 schematically demonstrates this function. The toilet seat assembly 10 incorporates a transmitter 240 for transmitting the operational data to relay station 242. The relay station transmits the operational data, such as battery status, anti-microbial sleeve supply status, error messages, and assembly identity information (i.e., building address and stall location and number), to a central monitoring station 244. It is appreciated that the remote relay station receives operational data from a number of assemblies. Status reports can be forwarded from the monitoring station 244 to the assembly's owner or operator 246 via facsimile, e-mail or text message on a pager, cellular telephone or personal digital assistant.

Preferably, the transmitter 240 disposed in the assembly is a wireless microwave transmitter that transmits radio frequency signals to the relay station 242. A transmitter of this type is well known in the art. This eliminates the need to hard-wire each assembly for communication with the relay station. It is appreciated that the relay station is located relatively close to the transmitter to avoid signal interference or other breaks in the communication link.

The relay station 242 transmits the operational status data via a wireless communication device, such as cellular telephone to a data interface 248 at the monitoring station 244. Alternatively, the relay station may transmit the operational status data to the monitoring station via a communications network, preferably the Internet or, alternatively, a local area network, a metropolitan area network or a wide area network. Through this communication link, the monitoring station 244 may also transmit information to the toilet seat assembly 10. This data may comprise repair instructions, updated software routines, updated instructions and information to be displayed on the display 220 (FIG. 13).

Figure 23:
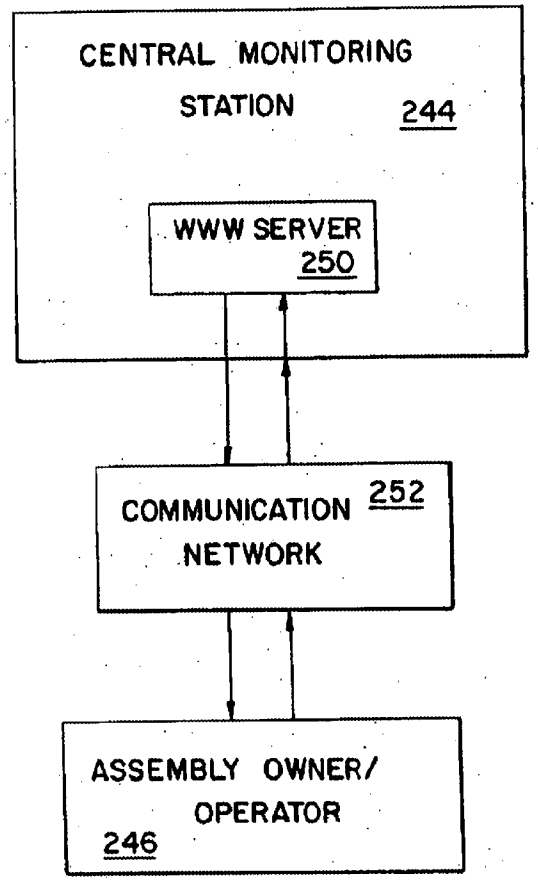
FIG. 23 shows a flow chart representation of the operation of the toilet seat assembly of FIG. 2.

Yet another aspect of the present invention shown in FIG. 23 enables the toilet seat assembly owner or operator 246 to access the data transmitted to the monitoring station 244.

The present invention contemplates utilizing a World Wide Web site to provide access to an account storing operational status data. The assembly owner/operator accesses can access the website 250 a via the Internet 252. Access can be obtained with any personal or notebook computer or Personal Digital Assistant equipped with a modem, a cellular telephone or pager with two-way text messaging capabilities, or any other communication device. It is appreciated that toilet seat assembly data is stored in a password-protected account. It is further appreciated that the owner/operator would be able to use electronic fund transfer technology to pay any service fees owed to the remote computer system operator over this communication link.

It is appreciated that the various improvements described herein can be used with many other sleeve dispensing devices and not only with the device described herein. Various concepts behind and aspects of the invention are also enumerated in the paragraphs below:

We claim:

1. A toilet seat assembly for dispensing a sleeve comprising:

a lower housing mounted to a first surface of a toilet;

an outer cover rotatably mounted to the lower housing, the outer cover configured to rotate between a first, closed position and a second, open position;

a sleeve dispenser disposed within a cavity defined by the lower housing and outer cover, the sleeve dispenser comprising a supply assembly and a take-up assembly configured to apply a take-up force to the sleeve;

a toilet seat ring mounted to the lower housing, the toilet seat ring having a thickness and comprising a first end associated with the supply assembly and a second end associated with the take-up assembly; and a sleeve tensioning device configured to tightly roll used segments of the sleeve from the toilet seat ring onto the take-up assembly, the sleeve tensioning device comprising a blade disposed at the second end of the toilet seat ring at half of the thickness of the toilet seat ring and a biasing member configured to bias the blade away from an interior surface of the toilet seat ring and slit the sleeve into an upper and lower segment as the take-up force advances the sleeve past the blade.

2. A toilet seat assembly for dispensing a sleeve comprising:

a housing mounted to a first surface of a toilet;

a sleeve dispenser disposed within the housing, the sleeve dispenser comprising a supply assembly and a take-up assembly configured to apply a take-up force to the sleeve;

a toilet seat ring mounted to the lower housing, the toilet seat ring having a thickness and comprising a first end associated with the supply assembly and a second end associated with the take-up assembly; and a sleeve tensioning device configured to tightly roll used segments of the sleeve from the toilet seat ring onto the take up assembly, the sleeve tensioning device comprising a blade disposed at the second end of the toilet seat ring, a biasing member configured to bias the blade away from an interior surface of the toilet seat ring and slit the sleeve into an upper and lower segment as the take-up force advances the sleeve past the blade and a take-up pin eccentrically mounted on an axle, the axle mounted to the sleeve dispenser at the second end of the toilet seat ring, the take-up pin configured to adjust on the axle to regulate the amount of take-up force applied to the upper and lower segments of the slit sleeve.

3. A toilet seat assembly for dispensing a plastic sleeve comprising: a lower housing mounted to a first surface of a toilet;

an outer cover rotatably mounted to the lower housing, the outer cover configured to rotate between a first, open position and a second, closed position; a sleeve dispenser disposed within a cavity defined by the lower housing and outer cover, the sleeve dispenser comprising a supply assembly and a take-up assembly configured to apply a take-up force to the sleeve;

a toilet seat ring mounted to the lower housing, the toilet seat ring having a thickness and comprising a first end associate with the supply assembly and a second end associated with the take-up assembly; and a sleeve tensioning device configured to tightly roll used segments of the sleeve from the toilet seat ring onto the take-up assembly, the sleeve tensioning device comprising a blade configured to slit the sleeve into an upper and lower segment and disposed at the second end of the toilet seat, and a take-up pin eccentrically and adjustably mounted to an axle mounted to the sleeve dispenser at second end of the toilet seat ring, the take-up pin configured to adjust on the axle to regulate the amount of take-up force applied to the upper and lower segments of the slit sleeve.

4. A toilet seat assembly for dispensing a plastic sleeve comprising:

a lower housing mounted to a first surface of a toilet;

an outer cover rotatably mounted to the lower housing, the outer cover configured to rotate between a first, open position and a second, closed position;

a sleeve dispenser disposed within a cavity defined by the lower housing and outer cover, the sleeve dispenser comprising a supply and a take-up;

a toilet seat ring mounted to the lower housing, the toilet seat ring comprising a first end associated with the supply and a second end associated with the take-up, and a tensioning knife receptacle and a hinge pin disposed therein at the take-up end of the toilet seat ring; and a tensioning knife configured to releasably mount to the toilet seat ring within the tensioning knife receptacle, the tensioning knife comprising a first, bladed end, a biasing member to bias the bladed end away from the toilet seat ring, a second end comprising a receptacle configured to releasably receive the hinge pin, and a pivot surface configured to communicate with a back wall of the tensioning knife receptacle and configured to pivot the tensioning knife in response to a pin releasing force applied to the bladed end of the knife and against the biasing of the biasing member.

5. A toilet seat assembly for dispensing a sleeve comprising:

a housing mounted to a first surface of a toilet;

a sleeve dispenser disposed within the housing, the sleeve dispenser comprising a supply assembly and a take-up assembly configured to apply a take-up force to the sleeve;

a toilet seat ring mounted to the housing, the toilet seat ring having an upper and lower surface and comprising a first end associated with the supply assembly and a second end associated with the take-up assembly; and a sleeve tensioning device configured to tightly roll used segments of the sleeve from the toilet seat ring onto the take-up assembly, the sleeve tensioning device comprising a blade disposed at an interior surface of the second end of the toilet seat ring at the second end substantially intermediate between the upper and lower surfaces and a biasing member configured to bias the blade away from an interior surface of the toilet seat ring and slit the sleeve into an upper and lower segment as the take-up force advances the sleeve past the blade, wherein the biasing member comprises a biasing arm integrally formed with a holder for securely holding the blade.

6. A toilet seat assembly for dispensing a sleeve comprising:

a housing mounted to a first surface of a toilet;

a sleeve dispenser disposed within the housing, the sleeve dispenser comprising a supply assembly and a take-up assembly configured to apply a take-up force to the sleeve;

a toilet seat ring mounted to the housing, the toilet seat ring having an upper and lower surface and comprising a first end associated with the supply assembly and a second end associated with the take-up assembly; and a sleeve tensioning device configured to tightly roll used segments of the sleeve from the toilet seat ring onto the take-up assembly, the sleeve tensioning device comprising a blade disposed at an interior surface of the second end of the toilet seat ring at the second end substantially intermediate between the upper and lower surfaces and a biasing member configured to bias the blade away from an interior surface of the toilet seat ring and slit the sleeve into an upper and lower segment as the take-up force advances the sleeve past the blade, wherein the biasing member comprises a leaf spring.

7. A toilet seat assembly for dispensing a sleeve comprising:

a housing mounted to a first surface of a toilet;

a sleeve dispenser disposed within the housing, the sleeve dispenser comprising a supply assembly and a take-up assembly configured to apply a take-up force to the sleeve;

a toilet seat ring mounted to the housing, the toilet seat ring having an upper and lower surface and comprising a first end associated with the supply assembly and a second end associated with the take-up assembly; and a sleeve tensioning device configured to tightly roll used segments of the sleeve from the toilet seat ring onto the take-up assembly, the sleeve tensioning device comprising a blade disposed at an interior surface of the second end of the toilet seat ring at the second end substantially intermediate between the upper and lower surfaces and a biasing member configured to bias the blade away from an interior surface of the toilet seat ring and slit the sleeve into an upper and lower segment as the take-up force advances the sleeve past the blade, wherein the housing comprises a lower housing mounted to the first surface of the toilet, and an outer cover rotatably mounted to the lower housing, wherein the outer cover is rotatable between a first, open position and a second, closed position.

8. A toilet seat assembly for dispensing a sleeve comprising:

a housing mounted to a first surface of a toilet;

a sleeve dispenser disposed within the housing, the sleeve dispenser comprising a supply assembly and a take-up assembly configured to apply a take-up force to the sleeve;

a toilet seat ring mounted to the housing, the toilet seat ring having an upper and lower surface and comprising a first end associated with the supply assembly and a second end associated with the take-up assembly; and a sleeve stretching device disposed at the second end of the toilet seat ring configured to stretch the sleeve advancing to the take-up assembly as the take-up force advances the sleeve past the stretching device, wherein the sleeve stretching device includes a biasing mechanism configured to bias the sleeve stretching device away from the toilet seat ring thereby stretching the sleeve.

9. The toilet seat according to claim 8 wherein the sleeve stretching device is a knife disposed at an interior surface of the second end of the toilet seat ring.

10. The toilet seat according to claim 8 wherein the sleeve stretching device is a knife disposed at the second end of the toilet seat ring configured to stretch and slit the sleeve as the take-up force advances the sleeve past the blade, the knife including a biasing mechanism to bias the knife away from the toilet seat ring.

11. The toilet seat of claim 8 wherein the sleeve stretching device is a finger disposed at an exterior surface of the second end of the toilet seat ring, the finger being biased away from the toilet seat ring to stretch the sleeve advancing to the take-up assembly as the take-up force advances the sleeve over the finger.

* * * * *